US008585561B2

(12) United States Patent
Watt et al.

(10) Patent No.: US 8,585,561 B2
(45) Date of Patent: Nov. 19, 2013

(54) EXERCISE BIKE

(75) Inventors: Jonathan B. Watt, Broomfield, CO (US); Kevin C. Andrews, Vancouver, WA (US); Daniel S. Munson, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 613 days.

(21) Appl. No.: 12/723,492

(22) Filed: Mar. 12, 2010

(65) Prior Publication Data

US 2010/0234185 A1 Sep. 16, 2010

Related U.S. Application Data

(60) Provisional application No. 61/160,241, filed on Mar. 13, 2009.

(51) Int. Cl.
*A63B 22/06* (2006.01)

(52) U.S. Cl.
USPC ..... 482/57; 482/63

(58) Field of Classification Search
USPC ..... 482/8, 57, 4, 5, 6, 63, 64
See application file for complete search history.

(56) References Cited

U.S. PATENT DOCUMENTS

| | | | |
|---|---|---|---|
| 2,406,344 | A | 8/1946 | Bergfors |
| 3,233,916 | A | 2/1966 | Bowden |
| 3,554,585 | A | 1/1971 | Sorrenson |
| 3,708,937 | A | 1/1973 | Sterner |
| 3,952,987 | A | 4/1976 | Bevington |
| 3,995,491 | A | 12/1976 | Wolfla, II |
| 4,003,168 | A | 1/1977 | Brady |
| 4,113,221 | A | 9/1978 | Wehner |
| D251,747 | S | 5/1979 | Valentine et al. |
| 4,165,854 | A | 8/1979 | Duly |
| 4,313,602 | A | 2/1982 | Sullivan |
| 4,337,503 | A | 6/1982 | Turner |

(Continued)

FOREIGN PATENT DOCUMENTS

| | | |
|---|---|---|
| DE | 29900028 | 4/1999 |
| EP | 0312207 | 4/1989 |

(Continued)

OTHER PUBLICATIONS

U.S. Appl. No. 29/333,781, filed Mar. 13, 2009, Lull.

(Continued)

*Primary Examiner* — Loan H. Thanh
*Assistant Examiner* — Shila Jalalzadeh Abyane
(74) *Attorney, Agent, or Firm* — Dorsey & Whitney LLP

(57) ABSTRACT

An exercise bike may include a magnetic braking system to resist rotation of a flywheel. The magnetic braking system may be magnets mounted on brackets selectively pivoted relative to the frame to increase or decrease the resistance opposing rotation of the flywheel. The brackets may be pivoted using a brake adjustment assembly joined to the brackets in such a manner that the magnetic forces resisting rotation of the flywheel increase or decrease in a proportional manner over at least a portion of the adjustment range of the brake adjustment assembly. The exercise bike may further include a console that displays information, such as power. The power may be estimated from a look-up table using the crank or flywheel speed of the exercise bike measured using a speed sensor and the tilt angle of the brackets relative to a reference point measured using a power sensor that includes an accelerometer.

17 Claims, 20 Drawing Sheets

(56) References Cited

U.S. PATENT DOCUMENTS

| | | | | |
|---|---|---|---|---|
| 4,340,125 | A | 7/1982 | Watanabe et al. | |
| 4,513,986 | A | 4/1985 | Trimble | |
| D280,117 | S | 8/1985 | Collins | |
| D280,118 | S | 8/1985 | Collins | |
| D280,226 | S | 8/1985 | Kasuba et al. | |
| 4,550,927 | A | 11/1985 | Resele | |
| D284,596 | S | 7/1986 | McNeil | |
| D285,953 | S | 9/1986 | Gustafsson | |
| 4,613,146 | A | 9/1986 | Sharp et al. | |
| D289,782 | S | 5/1987 | Szymski et al. | |
| D291,462 | S | 8/1987 | Aalto | |
| D291,713 | S | 9/1987 | Kiiski | |
| D292,225 | S | 10/1987 | Breger | |
| D292,304 | S | 10/1987 | Ostrom | |
| D296,457 | S | 6/1988 | Anitua | |
| D299,732 | S | 2/1989 | Gustafsson | |
| 4,824,102 | A | 4/1989 | Lo | |
| 4,936,570 | A | 6/1990 | Szymski et al. | |
| D313,055 | S | 12/1990 | Watterson | |
| 5,031,901 | A * | 7/1991 | Saarinen | 482/63 |
| 5,046,723 | A | 9/1991 | Szymski et al. | |
| 5,094,447 | A * | 3/1992 | Wang | 482/63 |
| 5,145,480 | A * | 9/1992 | Wang | 482/63 |
| 5,224,396 | A | 7/1993 | Lobbezoo et al. | |
| 5,285,696 | A | 2/1994 | Taylor | |
| 5,319,994 | A | 6/1994 | Miller | |
| 5,319,995 | A | 6/1994 | Huang | |
| 5,351,980 | A | 10/1994 | Huang | |
| 5,423,728 | A | 6/1995 | Goldberg | |
| 5,433,552 | A | 7/1995 | Thyu | |
| 5,451,071 | A | 9/1995 | Pong et al. | |
| 5,464,240 | A | 11/1995 | Robinson et al. | |
| 5,472,396 | A | 12/1995 | Brazaitis | |
| 5,499,961 | A | 3/1996 | Mattox | |
| D372,284 | S | 7/1996 | Wang et al. | |
| D380,796 | S | 7/1997 | Wang et al. | |
| D382,924 | S | 8/1997 | Wu | |
| D382,925 | S | 8/1997 | Wu | |
| 5,660,085 | A | 8/1997 | Tamplin | |
| D385,228 | S | 10/1997 | Thompson et al. | |
| 5,722,916 | A | 3/1998 | Goldberg | |
| 5,740,700 | A | 4/1998 | Redmond | |
| 5,772,916 | A | 6/1998 | Jamil et al. | |
| 5,823,919 | A * | 10/1998 | Eschenbach | 482/62 |
| D407,767 | S | 4/1999 | Chang | |
| 5,916,069 | A * | 6/1999 | Wang et al. | 482/72 |
| 5,934,631 | A | 8/1999 | Becker et al. | |
| 5,947,873 | A | 9/1999 | Sands et al. | |
| 5,957,425 | A | 9/1999 | Conway et al. | |
| 5,961,424 | A | 10/1999 | Warner et al. | |
| 5,996,145 | A | 12/1999 | Taylor | |
| 6,126,577 | A | 10/2000 | Chang | |
| 6,146,313 | A | 11/2000 | Whan-Tong et al. | |
| 6,162,152 | A | 12/2000 | Kuo | |
| 6,186,027 | B1 | 2/2001 | Nielsen | |
| 6,233,898 | B1 | 5/2001 | Burlando | |
| 6,264,878 | B1 | 7/2001 | Busby | |
| 6,383,121 | B1 | 5/2002 | Galasso et al. | |
| D460,133 | S | 7/2002 | Baker | |
| D460,794 | S | 7/2002 | Baker | |
| 6,413,191 | B1 | 7/2002 | Harris et al. | |
| 6,468,185 | B1 | 10/2002 | Goldberg | |
| 6,485,397 | B1 * | 11/2002 | Manderbacka | 482/63 |
| 6,491,606 | B1 * | 12/2002 | Swift | 482/57 |
| D473,602 | S | 4/2003 | Baudhuin et al. | |
| 6,551,226 | B1 | 4/2003 | Webber et al. | |
| D474,252 | S | 5/2003 | Lull et al. | |
| 6,564,673 | B1 | 5/2003 | Kilmer | |
| 6,569,063 | B2 * | 5/2003 | Chen | 482/63 |
| 6,612,600 | B2 | 9/2003 | Devitt et al. | |
| 6,612,970 | B2 | 9/2003 | Forcillo | |
| 6,669,603 | B1 | 12/2003 | Forcillo | |
| 6,695,752 | B2 * | 2/2004 | Lee | 482/63 |
| 6,793,608 | B2 | 9/2004 | Goldberg et al. | |
| 6,881,178 | B1 | 4/2005 | Goldberg | |
| 6,901,879 | B2 | 6/2005 | Burlando | |
| 6,905,445 | B1 | 6/2005 | Lin | |
| D507,313 | S | 7/2005 | Goldberg | |
| 6,918,860 | B1 | 7/2005 | Nusbaum | |
| 7,004,888 | B1 * | 2/2006 | Weng | 482/57 |
| 7,077,789 | B1 * | 7/2006 | Chen | 482/63 |
| 7,081,070 | B1 | 7/2006 | Washington et al. | |
| D526,031 | S | 8/2006 | Corbalis et al. | |
| D532,063 | S | 11/2006 | Kim et al. | |
| 7,172,532 | B2 | 2/2007 | Baker | |
| 7,175,570 | B2 | 2/2007 | Lull et al. | |
| 7,226,393 | B2 | 6/2007 | Baker | |
| 7,326,151 | B2 | 2/2008 | Peterson et al. | |
| 7,364,533 | B2 | 4/2008 | Baker | |
| D571,417 | S | 6/2008 | Su | |
| 7,413,530 | B2 | 8/2008 | Warner et al. | |
| D579,989 | S | 11/2008 | Bingham et al. | |
| 7,455,627 | B2 | 11/2008 | Goldberg | |
| 7,569,001 | B2 * | 8/2009 | Warner et al. | 482/63 |
| 7,591,765 | B2 | 9/2009 | Warner et al. | |
| D616,050 | S | 5/2010 | Lull | |
| 7,708,251 | B2 | 5/2010 | Watt et al. | |
| 7,785,236 | B1 * | 8/2010 | Lo | 482/63 |
| D624,612 | S | 9/2010 | Watt | |
| 7,806,809 | B2 * | 10/2010 | Bingham et al. | 482/57 |
| 7,901,334 | B2 * | 3/2011 | Chen et al. | 482/63 |
| 8,052,581 | B1 * | 11/2011 | Lohr et al. | 482/63 |
| 2002/0151414 | A1 | 10/2002 | Baker | |
| 2002/0193207 | A1 * | 12/2002 | Wang et al. | 482/63 |
| 2003/0064863 | A1 * | 4/2003 | Chen | 482/51 |
| 2003/0092534 | A1 * | 5/2003 | Forcillo | 482/57 |
| 2003/0166437 | A1 * | 9/2003 | Ho | 482/63 |
| 2003/0171191 | A1 | 9/2003 | Crawford et al. | |
| 2003/0211918 | A1 * | 11/2003 | Warner et al. | 482/57 |
| 2004/0053750 | A1 * | 3/2004 | Forcillo | 482/57 |
| 2004/0248701 | A1 | 12/2004 | Baker | |
| 2004/0248702 | A1 * | 12/2004 | Baker | 482/57 |
| 2005/0020410 | A1 * | 1/2005 | Chang | 482/63 |
| 2005/0130808 | A1 | 6/2005 | Lin | |
| 2006/0136173 | A1 | 6/2006 | Case, Jr. et al. | |
| 2007/0281835 | A1 * | 12/2007 | Baker | 482/57 |
| 2008/0096725 | A1 * | 4/2008 | Keiser | 482/8 |
| 2009/0011907 | A1 * | 1/2009 | Radow et al. | 482/57 |
| 2009/0227429 | A1 * | 9/2009 | Baudhuin | 482/57 |

FOREIGN PATENT DOCUMENTS

| | | |
|---|---|---|
| GB | 1281731 | 12/1972 |
| TW | 231529 | 10/1994 |
| TW | 304432 | 5/1997 |
| WO | WO 9625984 | 8/1996 |

OTHER PUBLICATIONS

U.S. Appl. No. 29/333,783, filed Mar. 13, 2009, Watt.
U.S. Appl. No. 29/345,698, filed Oct. 21, 2009, Watt.

* cited by examiner 9
170
140
176
146
168
180
148
106
178
186
172
174
130
9

168
176
180
106
148
178
186
184

146
172
192
174
130

234

TILT ANGLE (DEGREES)

| SPEED (RPM) | 0 | 1 | 2 | 3 | • | • | • | • | • | • | • | 17 | 18 | 19 | 20 |
|---|---|---|---|---|---|---|---|---|---|---|---|---|---|---|---|
| 0 | 0 | 0 | 0 | 0 | • | • | • | • | • | • | • | 0 | 0 | 0 | 0 |
| 5 | 1 | 1 | 1 | 1 | • | • | • | • | • | • | • | 6 | 6 | 6 | 7 |
| 10 | 2 | 2 | 3 | 3 | • | • | • | • | • | • | • | 24 | 24 | 25 | 25 |
| 15 | 4 | 5 | 6 | 6 | • | • | • | • | • | • | • | 52 | 52 | 52 | 52 |
| 20 | 5 | 6 | 7 | 8 | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| • | • | • | • | • | • | • | • | • | • | • | • | • | • | • | • |
| 105 | 27 | 32 | 45 | 69 | • | • | • | • | • | • | • | 999 | 999 | 999 | 999 |
| 110 | 30 | 34 | 47 | 73 | • | • | • | • | • | • | • | 999 | 999 | 999 | 999 |
| 115 | 32 | 36 | 50 | 79 | • | • | • | • | • | • | • | 999 | 999 | 999 | 999 |
| 120 | 33 | 38 | 54 | 84 | • | • | • | • | • | • | • | 999 | 999 | 999 | 999 |

*Fig. 19*

EXERCISE BIKE

CROSS-REFERENCE TO RELATED APPLICATIONS

This application claims, under 35 U.S.C. §119(e), the benefit of U.S. provisional application No. 61/160,241, titled "Exercise Bike" and filed on Mar. 13, 2009, the entire disclosure of which is hereby incorporated by reference herein in its entirety.

FIELD OF INVENTION

The present invention generally relates to exercise equipment, and more particularly to stationary exercise bikes.

BACKGROUND

As with other exercise equipment, exercise bicycles are continually evolving. Early exercise bicycles were primarily designed for daily in-home use and adapted to provide the user with a riding experience similar to riding a bicycle in a seated position. In many examples, early exercise bicycles include a pair of pedals to drive a single front wheel. To provide resistance, early exercise bicycles and some modern exercise bicycles were equipped with a friction brakes. The friction brake typically took the form of a brake pad assembly operably connected with a bicycle type front wheel so that a rider could increase or decrease the pedaling resistance by tightening or loosening the brake pad engagement with the front wheel. However, engagement of the brakes pads with the wheel wears down the pads resulting in an undesirable change of the resistance characteristics of the exercise bike over time.

Another evolution of the exercise bicycle is the replacement or substitution of the standard bicycle front wheel with a heavy flywheel and a direct drive transmission. The addition of the flywheel and direct drive transmission provides the rider with a riding experience more similar to riding a bicycle because a spinning flywheel has inertia similar to the inertia of a rolling bicycle and rider and enhances cardiovascular fitness by requiring the user to continue pedaling since there is no freewheeling. These types of exercise bikes are often known as indoor cycling bikes. Traditionally, these types of exercise bikes have provided to the user minimal to no information regarding pedal cadence, power, heart rate and so on. This type of information, however, can be useful to a user since these bikes are often used in group riding programs at health clubs or for other training where the programs and training focus on transitions between various different types of riding, such as riding at high revolutions per minute (RPM), low RPM, changing the resistance of the flywheel, standing up to pedal, leaning forward, riding within targeted heart rate or power ranges, and so on.

Accordingly, what is needed in the art is an improved exercise bike.

SUMMARY OF THE INVENTION

One embodiment of the present invention may take the form of an exercise bike. The exercise bike may include a frame, a drive train, a flywheel and an adjustment mechanism. The drive train may be operatively associated with the frame. The flywheel may be operatively associated with the drive train. The adjustment mechanism may include incremental units of adjustment for substantially linearly increasing a magnetic resistance force on the flywheel.

Another embodiment of the present invention may take the form of an exercise bike. The exercise bike may include a frame, a drive train, a flywheel, a braking system, and a power sensor. The drive train may be operatively associated with the frame. The flywheel may be operatively associated with the drive train. The braking system may be operatively associated with flywheel. The power sensor may be operatively associated the braking system. The power sensor may include an accelerometer that measures a position of the braking system relative to a predetermined reference point.

Yet another embodiment of the present invention may take the form of a method for estimating a power of an exercise bike. The method may include measuring a rotational speed of a flywheel of the exercise bike. The method may further include measuring a tilt angle of a magnetic brake operatively associated with the flywheel. The method may also include estimating power using the measured rotational speed and the measured tilt angle.

Still yet another embodiment of the present invention may take the form of an exercise bike. The exercise bike may include a frame, a drive train, a flywheel and a braking assembly. The drive train may be operatively associated with the frame. The flywheel may be operatively associated with the drive train The braking assembly may include an adjustment member and a magnetic brake. The adjustment member may define a longitudinal axis. The magnetic brake selectively may be operatively associated and selectively operatively disassociated with the flywheel by rotating the adjustment member around the longitudinal axis.

BRIEF DESCRIPTION OF THE DRAWINGS

FIG. 19 shows an example of a power look-up table for the exercise bike of FIG. 1.

DETAILED DESCRIPTION

Described herein are stationary exercise or indoor cycling bikes. These exercise bikes may include a flywheel rotated by a user via a drive train system. Resistance to rotation of the flywheel may be provided by an eddy current brake positioned proximate the flywheel. In some embodiments, the exercise bikes may include a monitoring system for determining the flywheel speed and the power output by the user. Such exercise bikes may further include a console for displaying information of interest, such as the crank speed and the user's power output.

Figure 1:
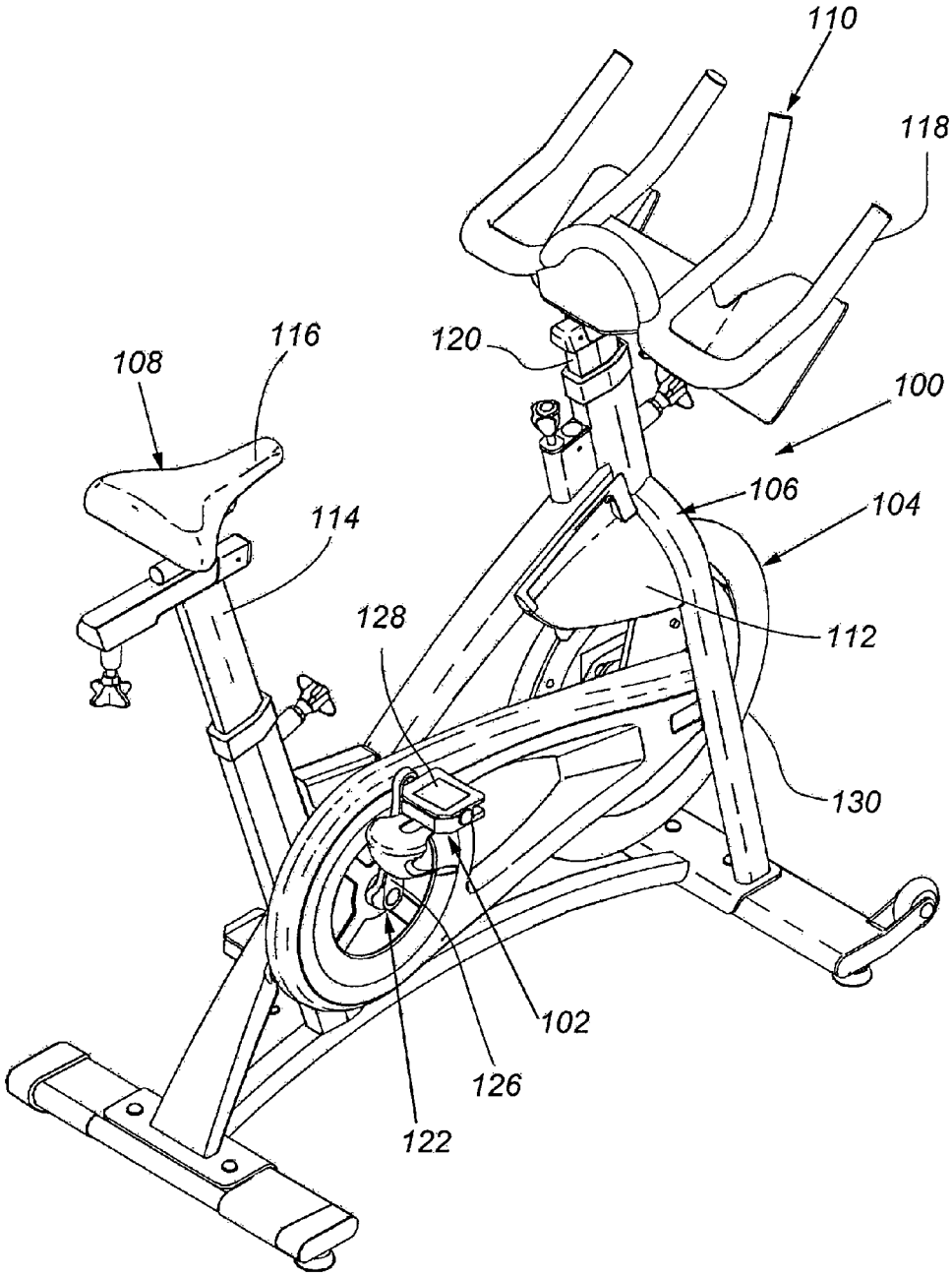
FIG. 1 shows a perspective view of an exercise bike.
Figure 2:
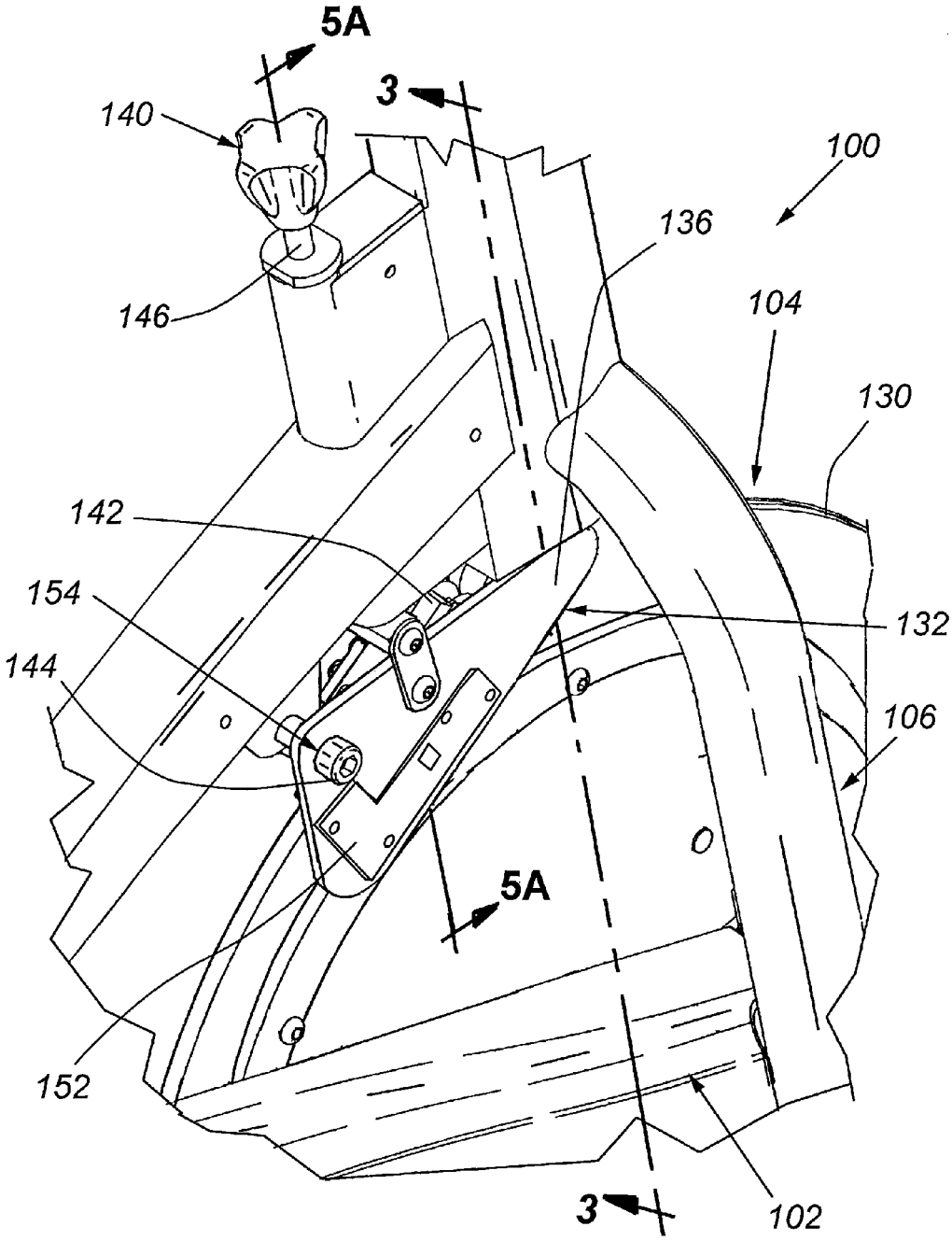
FIG. 2 shows a perspective view of a front portion of the exercise bike of FIG. 1.

FIG. 1 shows a perspective view of an exercise or indoor cycling bike 100, which may be referred to herein as either of the above. FIG. 2 shows a perspective view of a portion the exercise bike 100 with the shrouds removed to show portions of the drive train assembly 102 and the resistance assembly 104. The exercise bike may include a frame 106, a seat assembly 108, a handlebar assembly 110, the drive train assembly 102, the resistance assembly 104, a monitoring system (see FIG. 18), and a display system (see FIG. 17). The exercise bike 100 may further include one or more shrouds or covers 112 joined to the frame 106 to limit access by a user or others to moving portions of the drive train assembly 102 and resistance assembly 104.

With continued reference to FIG. 1, the seat assembly 108 may include a seat post 114 adjustably connected to the frame 106 to allow the user to adjust the vertical position of a seat 116 for supporting the user in a seated position. The seat 116 may also be adjustably supported by the seat post 114 to allow the user to adjust the horizontal position of the seat 116. The handlebar assembly 110 may include one or more handles 118 for a user to grasp. The handles 118 may take the form of bull horns, aero bars or any other handle used on exercise bikes. The handlebar assembly 110 may further include a handlebar post 120 connected to the frame 106 to allow the user to adjust the vertical and/or horizontal position of the handles 118.

Figure 3:
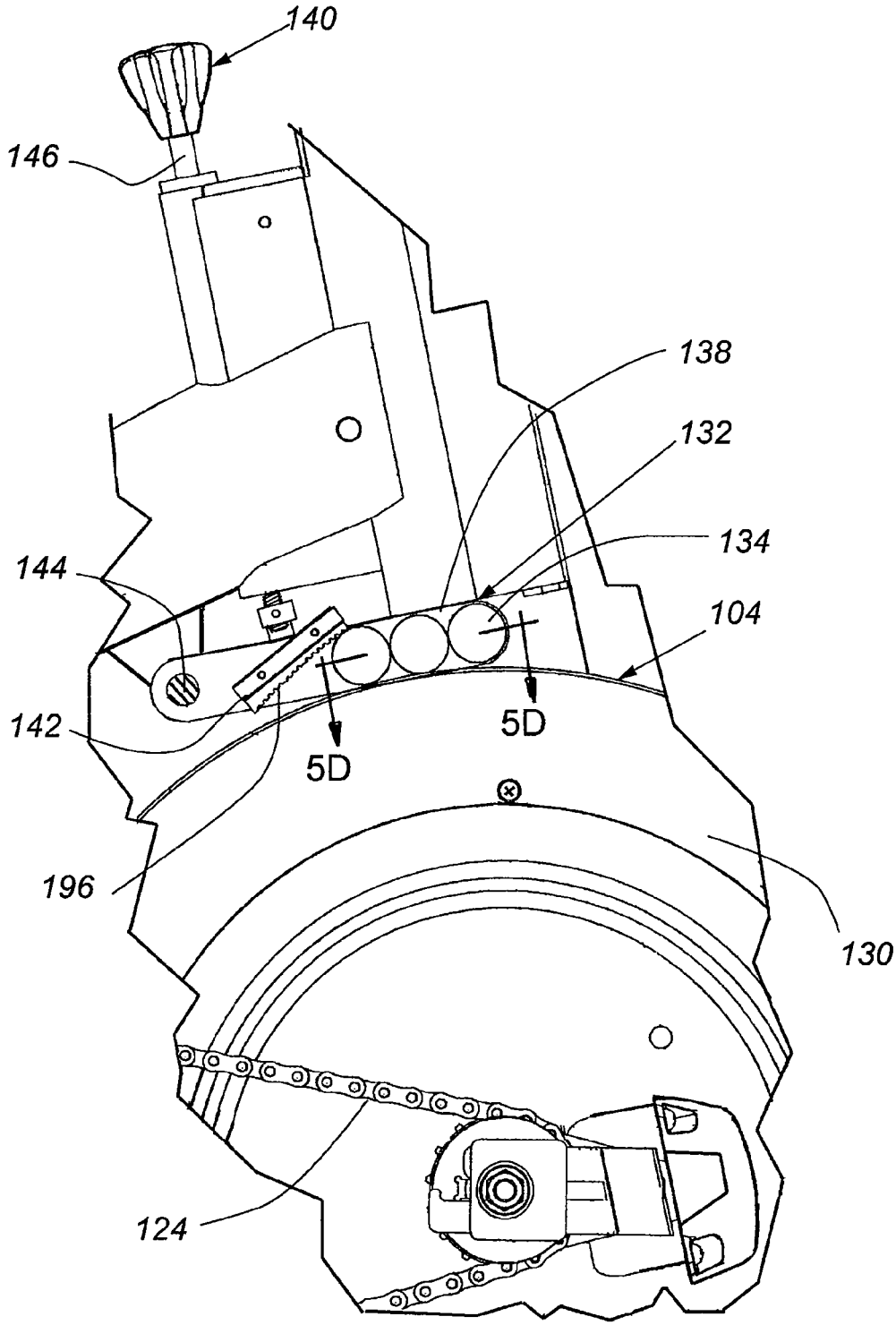
FIG. 3 shows a cross-section view of a front portion of the exercise bike of FIG. 1, viewed along section 3-3 in FIG. 2.

With reference to FIGS. 1-3, the drive train assembly 102 may include a crank assembly 122 rotatably supported by the frame 106 and a drive train connection member 124 for operatively joining the crank assembly 122 to the resistance assembly 104. The crank assembly 122 may include a crank or drive ring rotatably mounted on the frame 106 at a bottom bracket, crank arms 126 extending from the drive ring, and a pedal 128 joined to each crank arm 126 for allowing the user to engage the crank assembly 122. The drive train connection member 124 may be a chain, as shown in FIG. 3, a belt or any other suitable member for transferring rotation of the drive ring to a flywheel 130 of the resistance assembly 104.

With continued reference to FIGS. 1 and 2, the resistance assembly 104 may include the flywheel 130 and a brake assembly 132. The flywheel 130 may be rotatably mounted to the frame 106. The flywheel 130 may be further joined to the drive ring by the drive train connection member 124 such that rotation of the drive ring causes rotation of the flywheel 130. The flywheel 130 may be directly joined to the drive ring via the drive train connection member 124 or may be joined via a clutch, as is commonly known. The brake assembly 132 may be operatively associated with the flywheel 130 to resist or otherwise oppose rotation of the flywheel 130 using an eddy current braking system.

With reference to FIGS. 2-4B, the brake assembly 132 may be include one or more magnets 134, right and left brackets or arms 136, 138 (which may also be referred to as first or second brackets or arms), a brake adjustment assembly 140 and a friction brake 142. The magnets 134 may be positioned proximate the flywheel 130 to generate a magnetic field that resists rotation of the flywheel 130 as the flywheel 130 rotates past the magnets 134. To selectively change the position of the magnets 134 relative to the flywheel 130, the magnets 134 may be mounted on the right and left brackets 136, 138. The right and left brackets 136, 138 may, in turn, be pivotally mounted to the frame 106. The brake adjustment assembly 140 or adjustment mechanism may be used to pivot or otherwise move the right and left brackets 136, 138 relative to the frame 106. The brake adjustment assembly 140 may also be joined to the friction brake 142 for selective engagement of the friction brake 142 with the perimeter of the flywheel 130 to stop rotation of the flywheel 130.

The brake assembly 132 may be used to resist rotation of the flywheel 130 as follows. As the flywheel 130 rotates, it passes through a magnetic field generated by the magnets 134. This rotation of the flywheel 130 through the magnetic field creates a force that resists rotation of the flywheel 130. As the magnets 134 overlap a greater portion of the flywheel 130, the resistance to the rotation of the flywheel 130 by the magnetic field increases. An increase in the resistance to the rotation of the flywheel 130 rotation requires the user to exert more energy to rotate the flywheel 130 via the crank assembly 122. The amount of overlap of the magnets 134 with the flywheel 130 may be increased or decreased by selectively pivoting the brackets 136, 138 relative to the frame 106 using the brake adjustment assembly 140.

As the brackets 136, 138 are pivoted in a clockwise direction as viewed from the right side of the bike 100, the magnets 134 mounted on the brackets 136, 138 move towards the flywheel 130. Similarly, as the brackets 136, 138 are pivoted in a counterclockwise direction as viewed from the right side of the bike 100, the magnets 134 mounted on the brackets 136, 138 move away from the flywheel 130. Movement of the magnets 134 towards the flywheel 130 increases the forces opposing rotation of the flywheel 130 since the amount of overlap of the magnets 134 over the flywheel 130 increases, and movement of the magnets away 134 from the flywheel 130 decreases the forces opposing rotation of the flywheel 130 since the amount of overlap of the magnets 134 over the flywheel 130 decreases. The friction brake 142 may be utilized to rapidly stop rotation of the flywheel 130 by pressing down the brake adjustment assembly 140 until the friction brake 142 engages a peripheral portion of the flywheel 130. Because the friction brake 142 can rapidly stop rotation of the flywheel 130, it may be used as an emergency brake.

FIGS. 2-5B show various views of the exercise bike 100 that implement the various features of the resistance assembly 104 described above. The figures are merely representative of one possible way to implement these features into an exercise bike 100 and are not intended to imply or require these specific components nor limit use of other components to implement these features.

As discussed above, the brake assembly 132 may include right and left brackets 136, 138. The right and left brackets 136, 138 may be pivotally joined to the frame 106. Further, the brackets 136, 138 may be joined to move together. As shown in FIGS. 2 and 3, a free end of each bracket 136, 138 may extend from the pivot connection 144 towards the front of the bike 100. In some embodiments, the brackets 136, 138 could be pivotally joined to the frame 106 such that the free end of each bracket 136, 138 extends towards the rear of the bike 100. The configuration shown in FIGS. 2 and 3, however, may be helpful. Specifically, when the pivot connection 144 is positioned towards the front end of the brackets 136, 138 as opposed towards the rear end of the brackets 136, 138 as shown in FIGS. 2 and 3, rotation of the flywheel 130 tends to pull the brackets 136, 138 undesirably towards the flywheel 130.

The flywheel 130 pulling the brackets 136, 138 towards the flywheel 130 is undesirable because the brake adjustment assembly 140 includes a bias member 148, as described below, that maintains the position of an adjustment member 146 of the brake adjustment assembly 140 by opposing movement of the brake adjustment assembly 140 towards the flywheel 130. If the brackets 136, 138 are pulled towards the flywheel 130, the brackets 136, 138 pull the adjustment member 146 towards the flywheel 130, which requires a stiffer bias member to maintain the position of the adjustment member 146. However, the user must overcome the stiffness of the bias member 148 to move the adjustment member 146 down towards the flywheel 130 in order to engage the friction brake 142 with the flywheel 130. Thus, the bias member 148 should be maintained below a predetermined stiffness so that the user can readily engage the friction brake 142 with the flywheel 130 via the adjustment member 146. This goal can be more readily obtained when the brackets 136, 138 are not being pulled downward by the flywheel 130 as it rotates, which occurs when the brackets 136, 138 are pivoted at the front ends of the brackets 136, 138 as opposed to their rear ends. Regardless, the brackets 136, 138 may be pivoted about any suitable point to facilitate moving the magnets 134 over the flywheel 130.

Figure 4A:
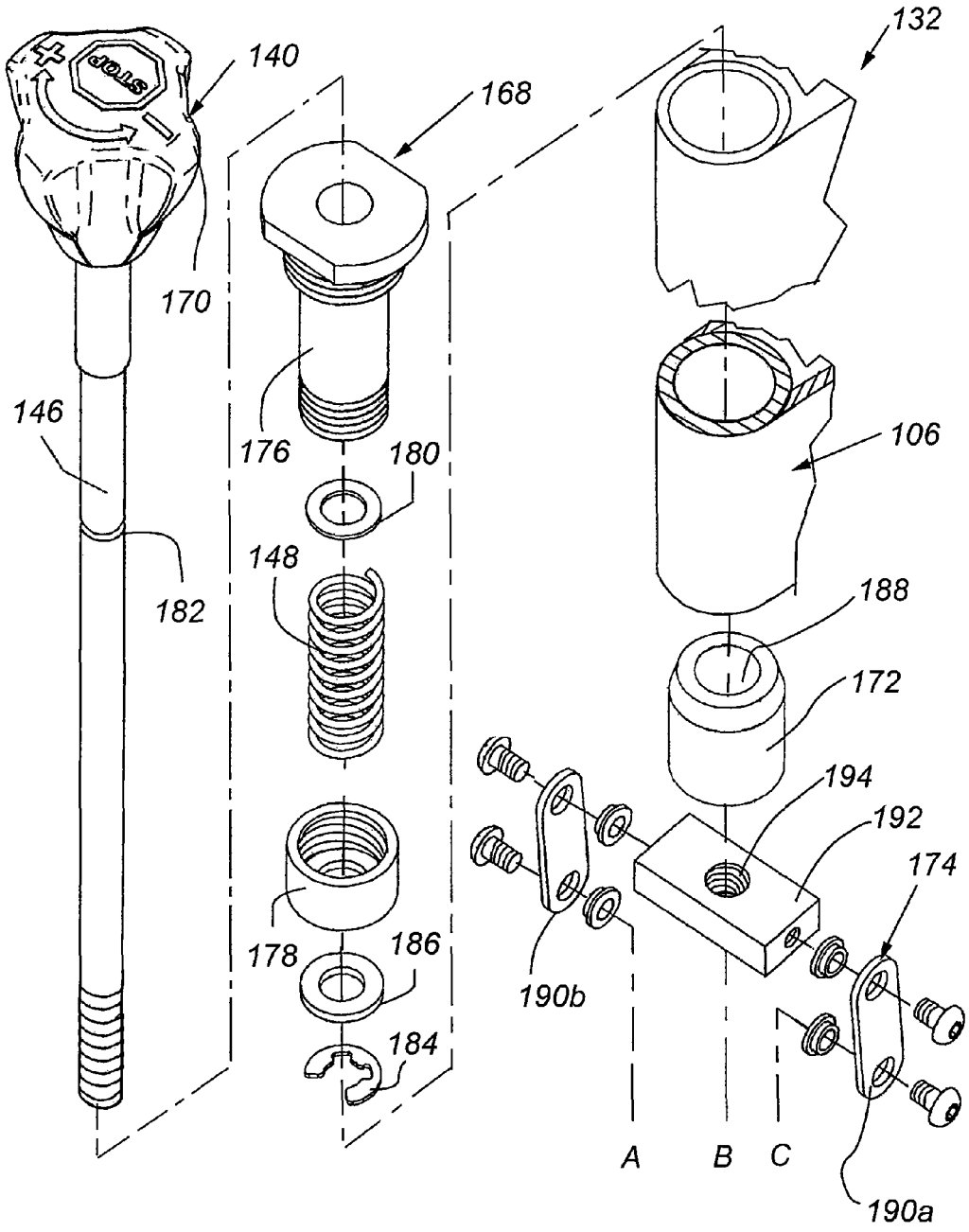
FIG. 4A shows an exploded perspective view of a portion of a brake assembly for the exercise bike of FIG. 1.
Figure 4B:
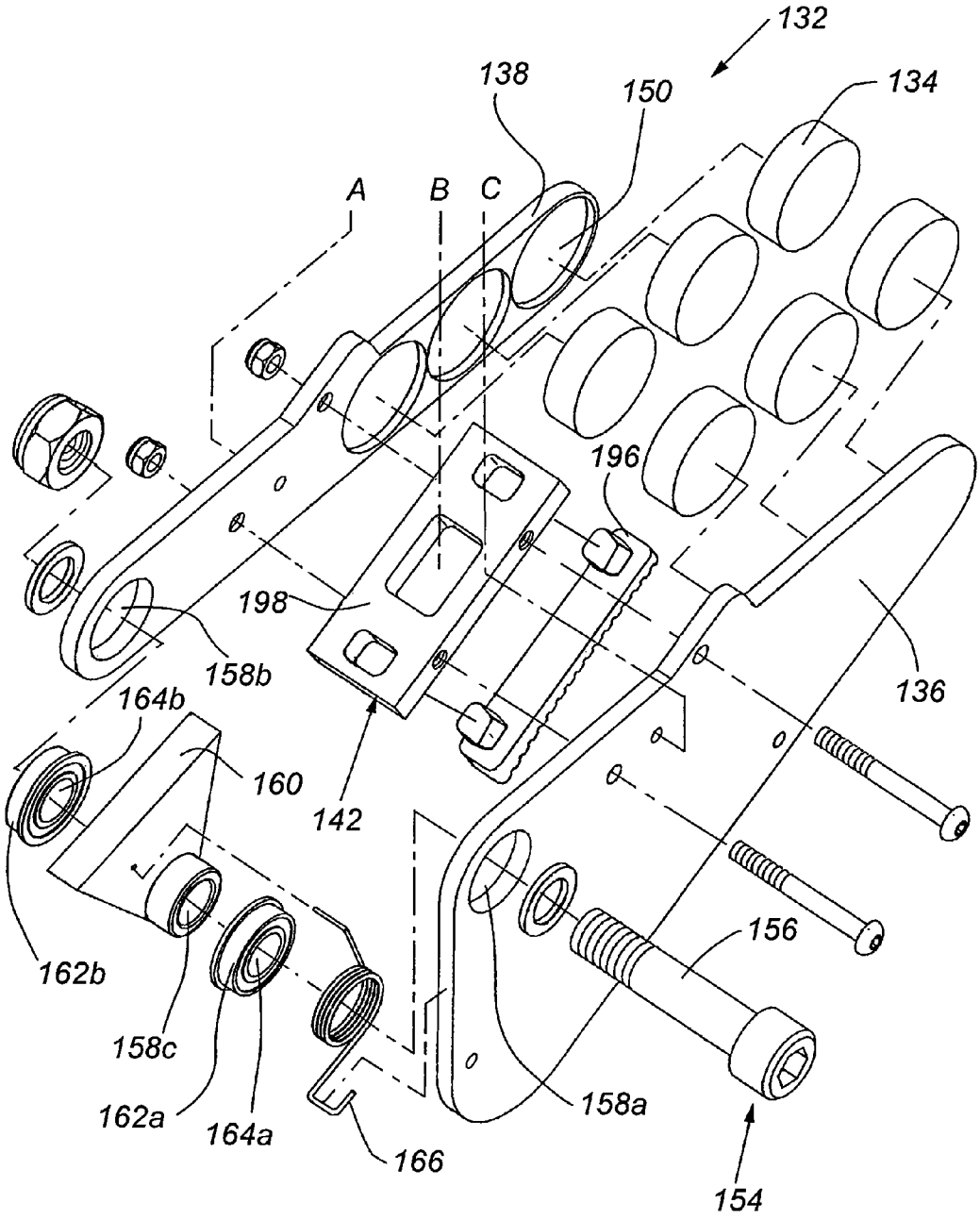
FIG. 4B shows an exploded perspective view of another portion of the brake assembly.

With reference to FIG. 4B, the right and left brackets 136, 138 may take the form of plates or the like. Each bracket 136, 138 may include one or more magnet recesses 150 sized for receiving at least a portion of one of the magnets 134. Each bracket 136, 138 may be any suitable shape that allows for one or more magnets 134 to be joined to the plate. As an example and with reference to FIGS. 2 and 4B, the right bracket 136 may be a generally triangular plate sized to fit a power sensor (discussed further below) and three magnets 134 on the bracket 136. The three magnets 134 may be aligned on a linear or curved line along an upper portion of the plate. To limit the size of the plate, each magnet 134 may be spaced relatively close to adjacent magnets 134. Closely spacing the magnets 134 also creates a more proportional increase in the forces opposing the flywheel 130 when overlapping the flywheel 130 with the magnets 134. The power sensor 152 may be connected to a lower portion of the plate on an outward facing side of the plate. With reference to FIG. 4B, the left bracket 138 may be a generally rectangular plate. Like the right bracket 136, three magnets 134 may be aligned on the left bracket 138 on a linear or curved line. Although the shape of each bracket differs as shown in FIG. 4B, each bracket 136, 138 could have the same shape in other versions of the exercise bike.

The brackets 136, 138 may be formed from a conductive metal or other material that allows the magnets 134 to be magnetically joined to the brackets 136, 138. Alternatively, the magnets 134 could be joined to a magnetic or non-magnetic material using other connection methods such as friction fit connections, mechanical fasteners, adhesives and so on. Further, although three magnets 134 are shown in figures as joined to each of the right and left brackets 136, 138, more or less than three magnets 134 may be joined to each bracket 136, 138.

Figures 5A, 5B, 5C:
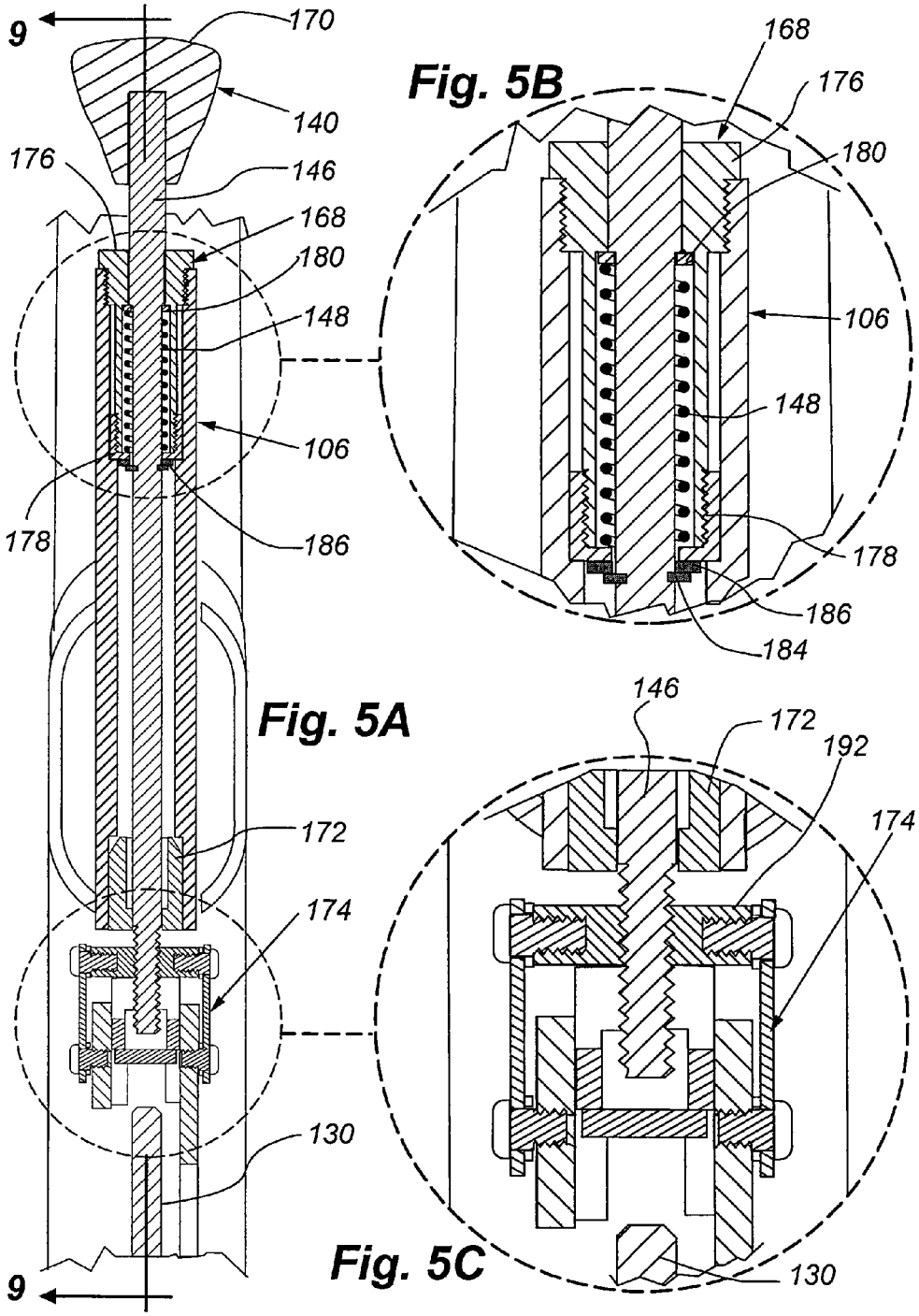
FIG. 5A shows a cross-section view of a front portion of the exercise bike of FIG. 1, viewed along section 5A-5A in FIG. 2.
FIG. 5B shows an enlarged portion of the cross-section view shown in FIG. 5A.
FIG. 5C shows an enlarged portion of the cross-section view shown in FIG. 5A.
Figure 5D:
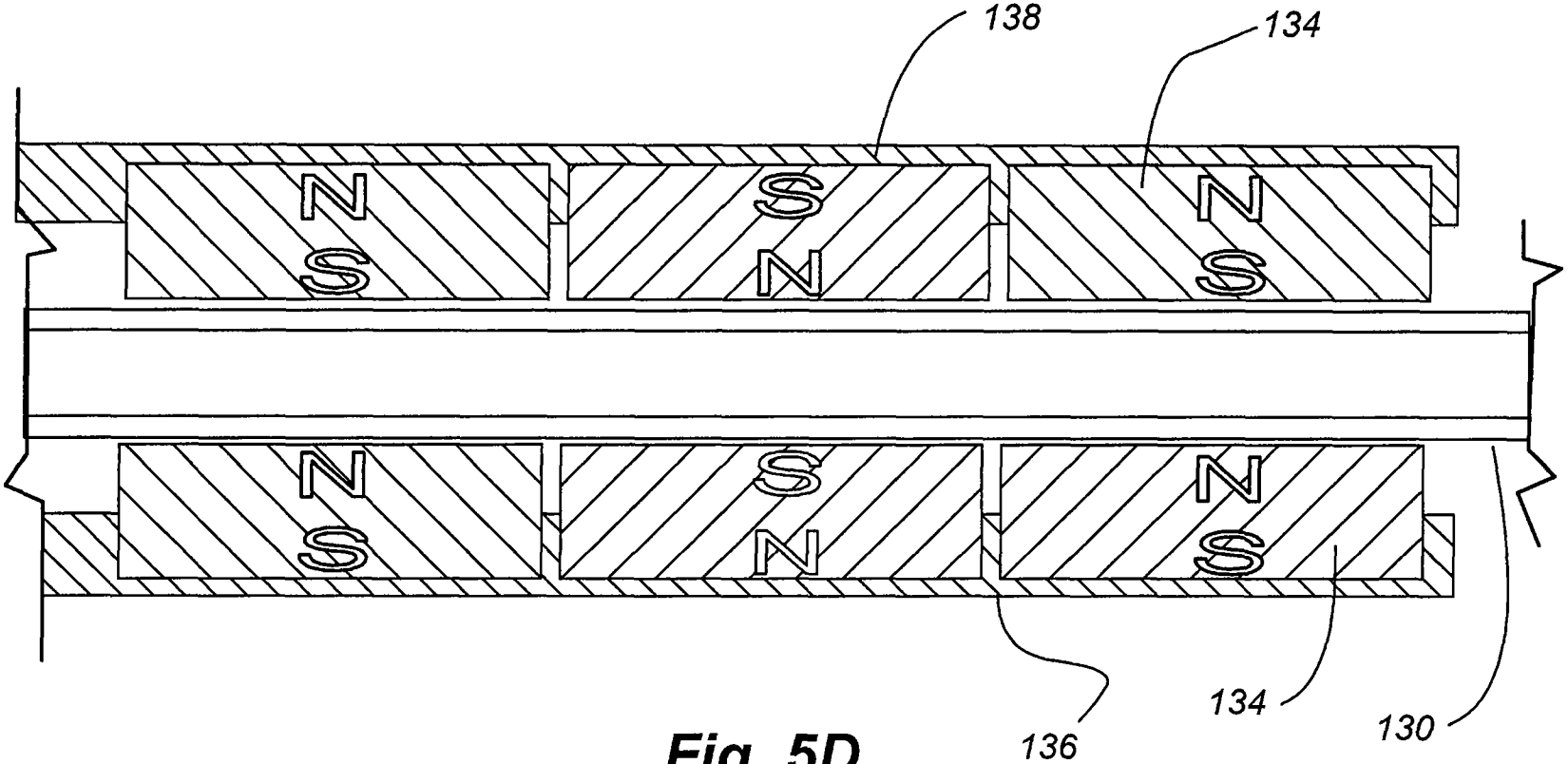
FIG. 5D is a cross-section view of a portion of the brake assembly view along section 5D-5D in FIG. 3, showing a potential polar alignment of the magnets for the exercise bike.

The magnets 134 used in the brake assembly 132 may be formed from rare earth elements or any other suitable magnetic material. The magnets 134 may be circular or any other suitable shape. Circular magnets result in a more uniform positioning of the magnets 134 around the flywheel 130. When using more than one magnet 134, the magnets 134 may be positioned on each bracket such that the pole nearest the flywheel 130 alternates from North to South for each magnet 134 as shown in FIG. 5D. Further, the pole of the magnet 134 facing towards the flywheel 130 on one bracket 136 may be positioned to be opposite the pole facing towards the flywheel 130 of corresponding magnet 134 on the other bracket 138 as also shown in FIG. 5D. Configuring the magnets 134 in the manner shown in FIG. 5D limits degradation in the resistance experienced by the flywheel 130 compared to configurations in which the poles of the magnets 134 are not positioned in an alternating arrangement as shown in FIG. 5D.

Returning to FIGS. 2 and 4B, the brake assembly 132 may further include a bracket pivot assembly 152 for pivotally joining the right and left brackets 136, 138 to the frame 106. Specifically, the bracket pivot assembly 154 may include a pivot member or axle 156, such as a bolt or the like, received through co-axially aligned bracket pivot holes 158*a-c* formed in each bracket 136, 138 and in a bracket support member 160 extending from the frame 106. A longitudinal axis of the pivot member 156 defines a pivot axis around which the brackets 136, 138 pivot. The bracket pivot assembly 154 may further include right and left bracket bearings 162*a-b* received within the right and left bracket pivot holes 158*a-b* to facilitate the pivoting of each bracket 136, 138 around the pivot axis. To join the bracket bearings 162*a-b* to the pivot member 156, each brake bracket bearing 162*a-b* may define an aperture 164*a-b* for receiving the pivot member 156 therethough. A bracket spring 166 may be joined to the bracket support member 160 and a bracket 136 to maintain the relative pivotal position of the brackets 136, 138 relative to the bracket support member 160 when the brackets 136, 138 are not being selectively pivoted or otherwise moved by the user.

With reference to FIGS. 4A and 5A-5C, the brake adjustment assembly 140, which may also be referred to as the adjustment mechanism, may include a biasing member assembly 168, the adjustment member 146, a control knob 170, an adjustment bearing member 172 and a link assembly 174. The bias member assembly 168 may include an upper bias member housing 176 and a lower bias member housing 178. The lower bias member housing 178 may be joined by threads to a lower portion of the upper bias member housing 176 to define a bias member housing. The joined upper and lower bias member housings 176, 178 define a substantially enclosed space for receiving the bias member 148, such as a spring, and a portion of the adjustment member 146. The bias member 148 biases the adjustment member 146 to a predetermined position relative to the frame 106 when not engaged by the user. The bias member 148 should have a sufficient stiffness to maintain the adjustment member 146 in the predetermined position when not engaged by the user. The biasing member assembly 168 may be received within a space defined by the bike frame 106. The biasing member assembly 168 may be joined to the bike frame 106 using threads defined on the upper bias member housing 176 or by any other suitable connection method.

The adjustment member 146 may be a generally cylindrical rod or any other suitable shaped rod or other elongated member defining a longitudinal axis. A portion of the adjustment member 146 may be received within the bias member housing. Proximate an upper end of the bias member 148, the cross-section area of the adjustment member 146 transverse to the longitudinal axis of the adjustment member 146 may be changed to define an engagement surface for engaging the upper end of the bias member 148. A washer 180 or the like may be positioned between the upper end of the bias member 148 and engagement surface of the adjustment member 146. Proximate a lower end of the bias member housing, the adjustment member 146 may include a clip groove 182. A clip ring 184, such as a E clip, may be received in the clip groove 182. The clip ring 184 engages a bottom end of the bias member housing via a second washer 186 to maintain engagement of the adjustment member 146 with the bias member 148. A lower portion of the adjustment member 146 may be threaded for movably joining the adjustment member 146 to the link assembly 174.

Proximate a lower portion of the adjustment member 146, the adjustment bearing member 172 may be joined to the bike frame 106 by a suitable connection method. The adjustment member 146 may be received through a bearing aperture 188 defined in the adjustment bearing member 172. The adjustment member 146 can be rotated within the bearing aperture 188 and can be moved vertically through the bearing aperture 188. The adjustment bearing member 172, however, prevents the adjustment member 146 from moving in directions other than vertical.

The control knob 170 may be joined to an upper portion of the adjustment member 146. The control knob 170 provides an object for the user to engage to rotate the adjustment member 146 about the longitudinal axis of the adjustment member 146 and to move the adjustment member 146 vertically. As described below, rotation of the adjustment member 146 about its longitudinal axis changes the position of the magnets 134 relative to the flywheel 130. Moving the adjustment member 134 vertically downward allows the friction brake 142 to be engaged with the flywheel 130.

The link assembly 174 joins the adjustment member 146 to the right and left brackets 136, 138. With reference to FIGS. 4A and 5C, the link assembly 174 may include right and left links 190*a-b* (which may also be referred to as first and second links) and a link plate 192. Upper portions of the right and left links 190*a-b* may be pivotally joined to the link plate 192. Lower portions of the right and left links 190*a-b* may be pivotally joined to the right and left brackets 136, 138, respectively. The link plate 192 may include a threaded link plate hole 194 for joining by threaded engagement the link assembly 174 to the adjustment member 146. Selective rotation of the adjustment member 146 about its longitudinal axis moves the link plate 192 along the threaded portion of the adjustment member 146. As the link plate 192 moves along the threaded portion of the adjustment member 146, the link assembly 174 pivots the brackets 136, 138 relative to the flywheel 130 via connection of the right and left links 190*a-b* to the link plate 192 and the right and left brackets 136, 138.

With reference to FIGS. 3 and 4B, the friction brake 142 may be a brake pad 196 formed from rubber or other suitable material and joined to a brake pad support 198. The brake pad 196 may be positioned between and joined to the right and left brackets 136, 138. A lower portion of the brake pad 196 may be curved to conform to the outer surface of the flywheel 130. Such curving facilitates a more uniform engagement of the lower surface of the brake pad 196 with the outer radial surface of the flywheel 130. The brake pad 196 may also be positioned at an angle relative to a vertical axis to also cause a more uniform engagement of the lower surface of the brake pad 196 with the outer radial surface of the flywheel 130.

Figure 6:
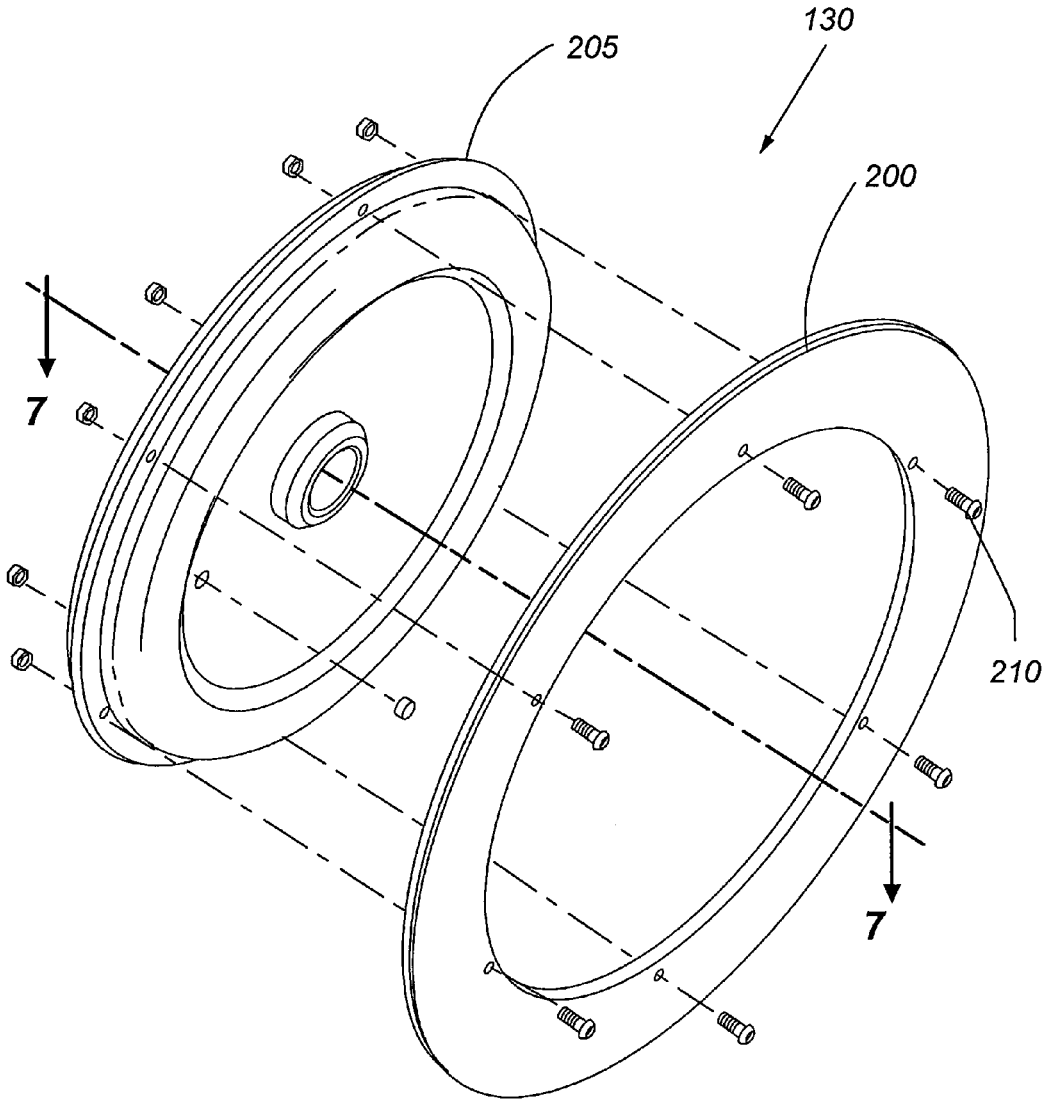
FIG. 6 shows an exploded perspective view of a flywheel for the exercise bike of FIG. 1.
Figure 7:
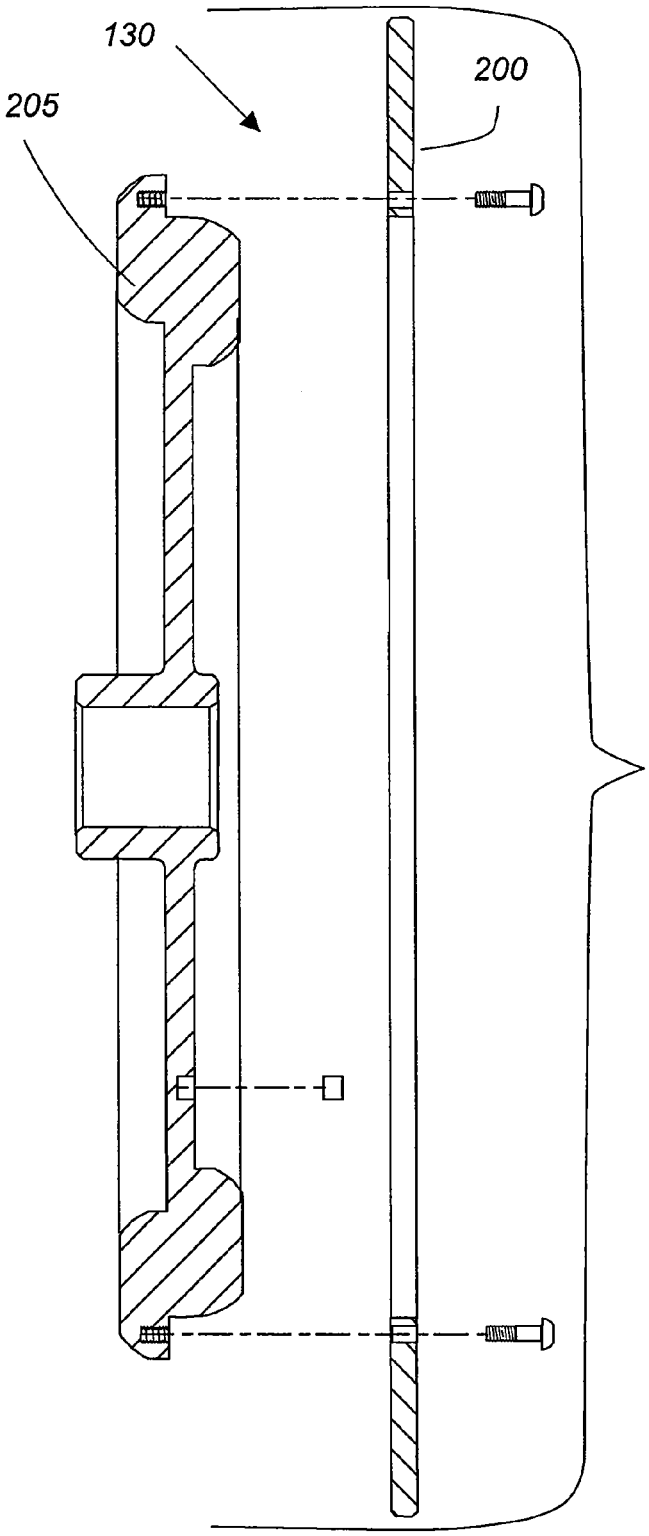
FIG. 7 shows an exploded cross-section view of the flywheel, viewed along line 7-7 in FIG. 6.
Figure 8:
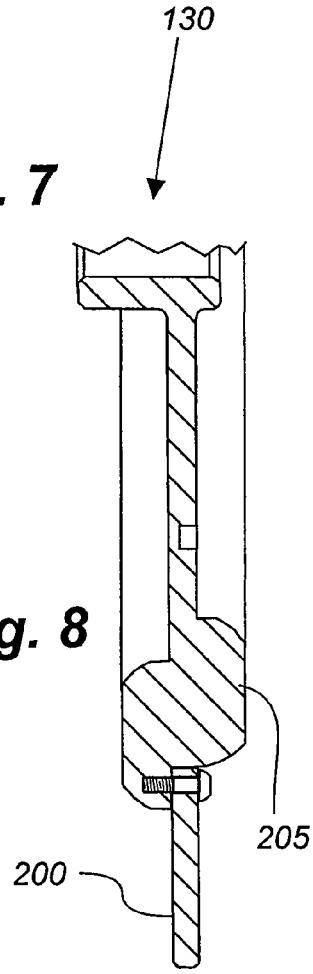
FIG. 8 shows a partial cross-section view of the flywheel similar to the view shown in FIG. 7 except the flywheel is shown in an assembled view.

With reference to FIGS. 6-8, the flywheel 130 may be formed from two or more materials. An outer radial portion 200 of the flywheel 130 may be formed from a conductive, non-ferrous material, such as aluminum or copper, and an inner radial portion 205 of the flywheel 130 may be formed from a relatively dense material, such as steel. Use of conductive, non-ferrous material for the outer radial portion 200 of the flywheel 130 and a relatively dense material for the inner radial portion 205 of the flywheel 130 allows for the eddy current brake effect on the flywheel 130 via use of the magnets 134 while allowing for a relatively smaller overall flywheel 130 for a desired flywheel inertial mass. More particularly, in order to generate, with the magnetic field, forces that resist rotation of the flywheel 130, the portion of the flywheel 130 passing through the magnetic field needs to be formed from a conductive material. Non-ferrous conductive materials, such as aluminum, are preferred over ferrous conductive materials. Aluminum, however, tends to be less dense than other materials, such as steel. Thus, to achieve a desired inertial mass, a flywheel 130 made entirely from aluminum generally needs to be larger than a flywheel 130 made from steel. Using a denser material, such as steel, for the inner radial portion 205 and aluminum for the outer radial portion 200 of the flywheel 130 allows for a relatively smaller flywheel 130 to be used on the exercise bike 100 compared to an all aluminum flywheel 130 while obtaining the benefits of passing a non-ferrous conductive material through the magnetic field to generate a resistive force to the rotation of the flywheel 130.

With continued reference to FIGS. 6-8, the non-ferrous conductive portion 200 of the flywheel 130 may be formed into an annular ring. The inner radial portion 205 of the flywheel 130 may extend a greater radial distance on one side of the flywheel 130 to define a radial surface for joining the annular ring to the inner radial portion 205 of the flywheel 130. Fasteners 210, such as screws or the like, may be used to join the non-ferrous portion 200 of the flywheel 130 to the inner radial portion 205 of the flywheel 130. The outer and inner radial portions 200, 205 of the flywheel 130 could be joined by other connection methods, such as welds, adhesives and so on. Further, although the flywheel 130 is shown and described as formed from two materials, the flywheel 130 could be formed from a single material, such as aluminum or copper.

Figures 9, 10:
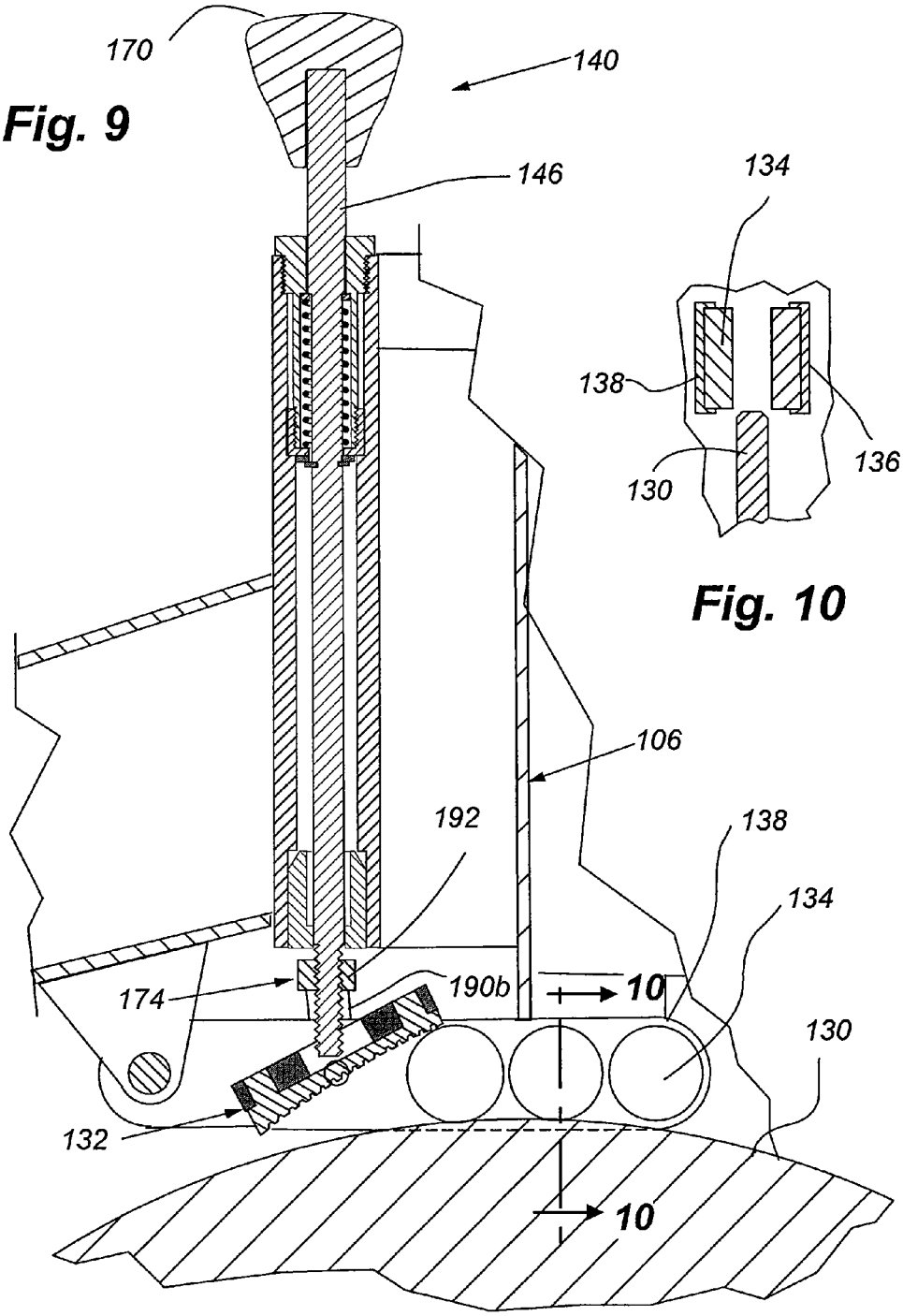
FIG. 9 shows a cross-section view of the brake assembly of the exercise bike showing the brake assembly in a first position, viewed along line 9-9 in FIG. 5A.
FIG. 10 shows a cross-section view of a portion of the brake assembly viewed along line 10-10 in FIG. 9.
Figures 11, 12:
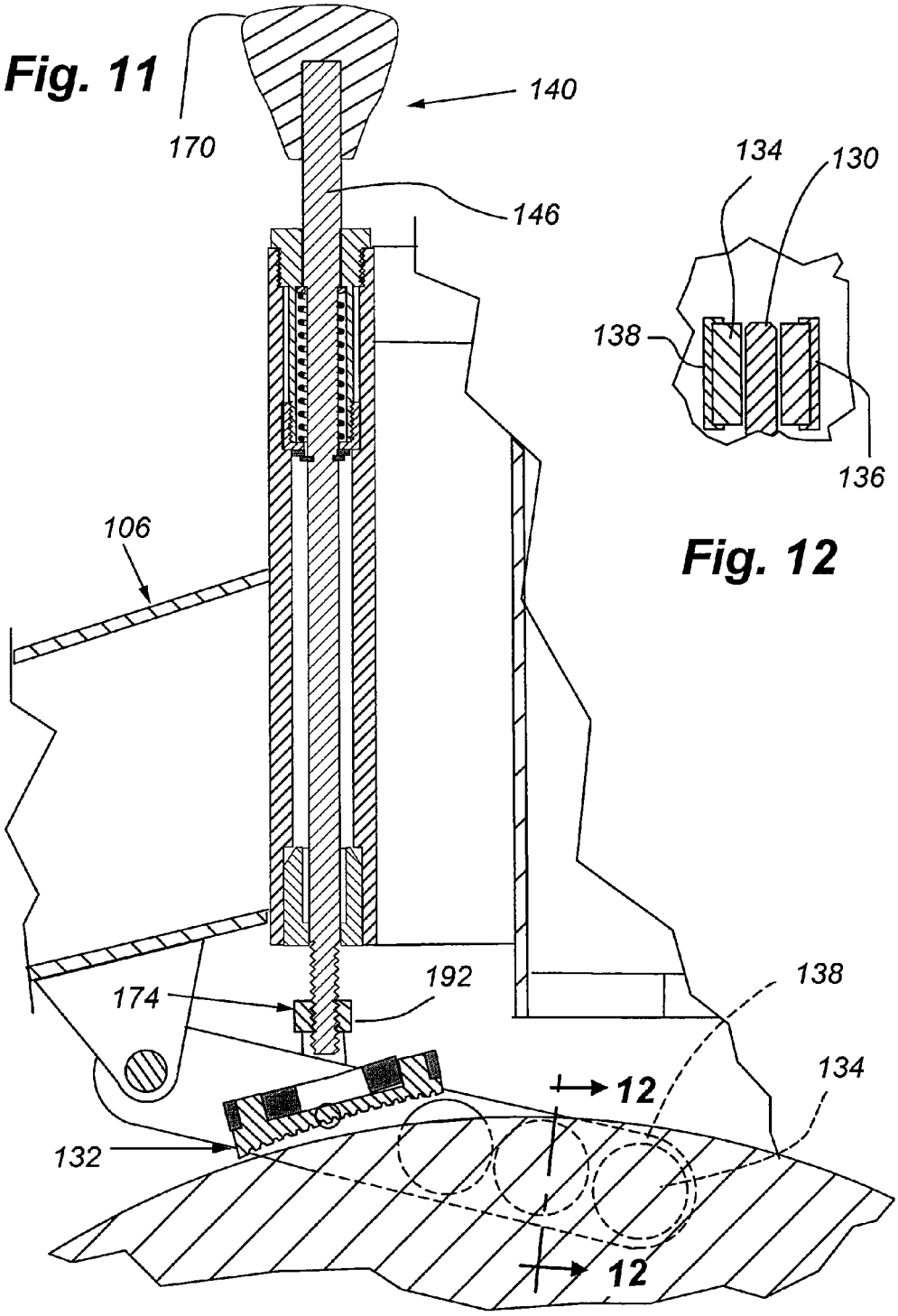
FIG. 11 shows a cross-section view of the brake assembly of the exercise bike similar to the view shown in FIG. 9, showing the brake assembly in a second position.
FIG. 12 shows a cross-section view of a portion of the brake assembly viewed along line 12-12 in FIG. 11.
Figure 13:
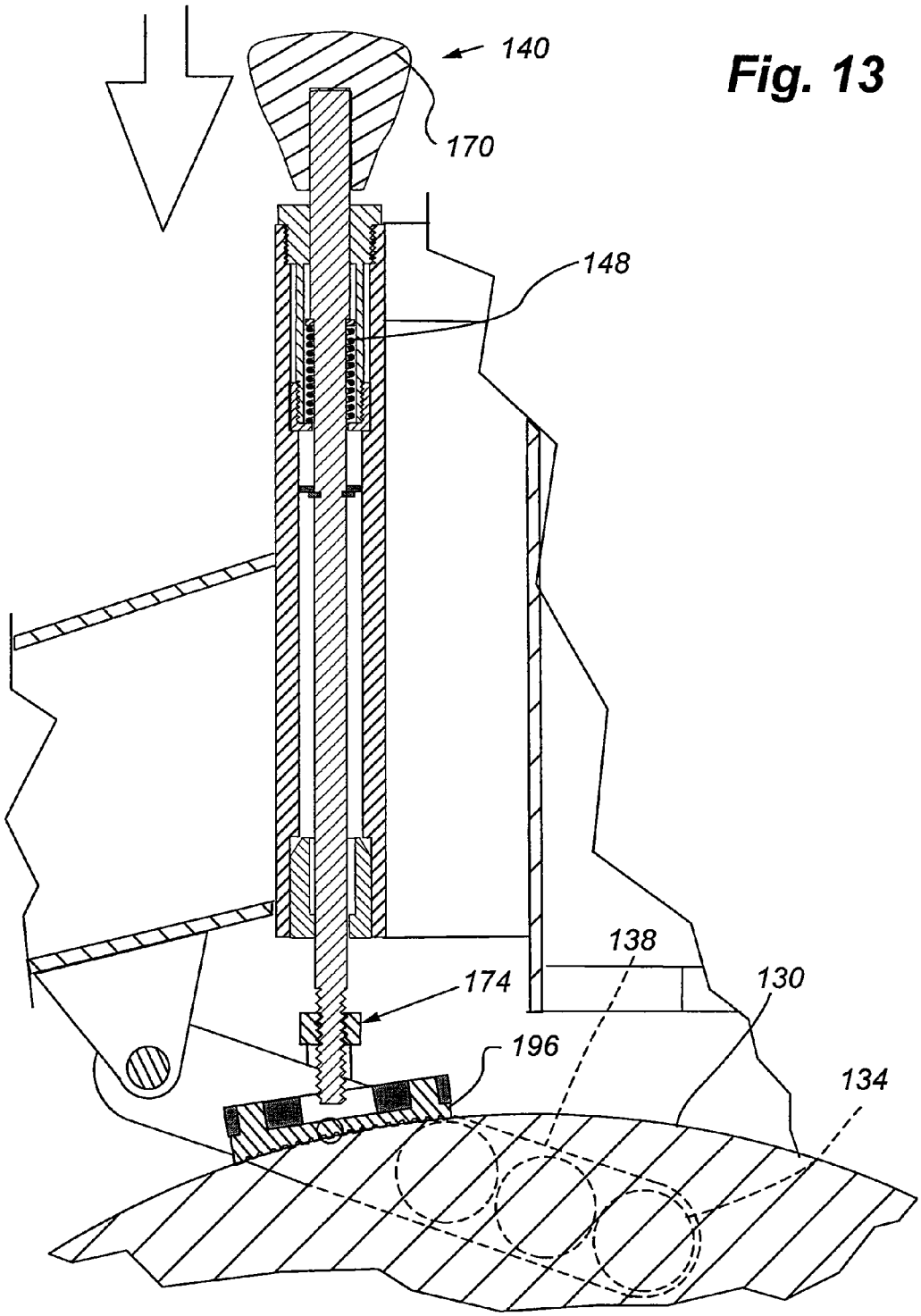
FIG. 13 shows a cross-section view of the brake assembly with a friction brake engaged with the flywheel.

Operation of the resistance assembly 104 shown in FIGS. 2-5A will now be described with reference to FIGS. 9-14D. FIG. 9 is a section through 9-9 of FIG. 5A, and thus only the left bracket 138 and left link 190*b* are shown. FIGS. 11 and 13 are representative cross-sections similar to FIG. 9 and are used to show the brake assembly in different positions relative to the flywheel 130. FIGS. 10 and 12 are sections through 10-10 of FIGS. 9 and 12-12 of FIG. 11, respectively, and are used to show the relative position of the magnets 134 for different positions of the brake assembly 132 relative to the flywheel 130.

FIGS. 9 and 10 show the brake assembly 132 in an upper or start position. In this upper position, further upward movement of the left and right brackets 136, 138 is prevented by engagement of the brackets 136, 138 with the frame 106. Also, in this upper position, the magnets 134 do not overlap the flywheel 130, and thus the flywheel 130 may rotate with little or no resistance applied to it by the magnetic brake system.

Rotation of the adjustment member 146 in a clockwise direction as viewed from above the adjustment member 146 causes the link plate 192 of the link assembly 174 to move vertically downward along the adjustment member 146. The link plate 192 is joined to the bracket members 136, 138 by the right and left links 190*a-b*. Thus, as the link plate 192 moves vertically downward, it causes the brackets 136, 138 to pivot relative to the frame 106 in a direction towards the flywheel 130. As the bracket members 136, 138 pivot in this direction, the magnets 134 begin to overlap the flywheel 130. As the overlap increases, the resistance provided by the magnets 134 to rotation of the flywheel 130 also increases. Continued rotation of the adjustment member 146 in the clockwise direction as viewed from above the adjustment member 146 causes the brackets 136, 138 to gradually progress from the position shown in FIG. 9 to the position shown in FIG. 11, such that the magnets 134 move from a position not overlapping the flywheel 130 as shown, for example, in FIG. 10 to a position that the magnets 134 overlap the flywheel 130 as shown, for example, in FIG. 12.

To reduce the resistance provided by the magnetic brake, the adjustment member 146 may be rotated in a counterclockwise direction as viewed from above. Rotation of the adjustment member 146 in this direction causes the link plate 192 to move upward along the threaded portion of the adjustment member 146. Movement of the link plate 192 upward causes the brackets 136, 138 to pivot relative to the frame 106 in a direction away from the flywheel 130. As the brackets 136, 138 pivot in this direction, the amount of the overlap of the flywheel 130 by the magnets 134 decreases. As the overlap decreases, the resistance provided by the magnets 134 to rotation of the flywheel 130 decreases.

To provide a proportional increase in the opposition forces for a least a portion of the movement range of the adjustment assembly 140 for each incremental unit of movement of the adjustment assembly 140, the adjustment assembly 140 may be configured to decrease the movement of the magnets 134 towards the flywheel 130 for each incremental unit of movement of the adjustment assembly by the user for a least a portion of the movement range of the adjustment assembly. For example, the adjustment assembly 140 shown in FIGS. 9-13 allows the user to move the magnets 134 by rotation of the control knob 170. When the user rotates the control knob 170 one full revolution, the magnets 134 move towards the flywheel 130 from the position shown in FIG. 14A to the position shown in FIG. 14B. When the user rotates the control knob 170 another full revolution, the magnets 134 move towards the flywheel 130 from the position shown in FIG. 14B to the position shown in FIG. 14C.

Figure 14B:
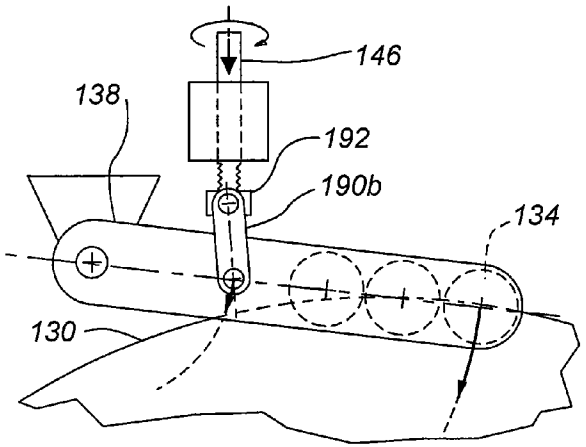
FIG. 14B shows a schematic of a portion of the brake assembly in a second position.
Figure 14D:
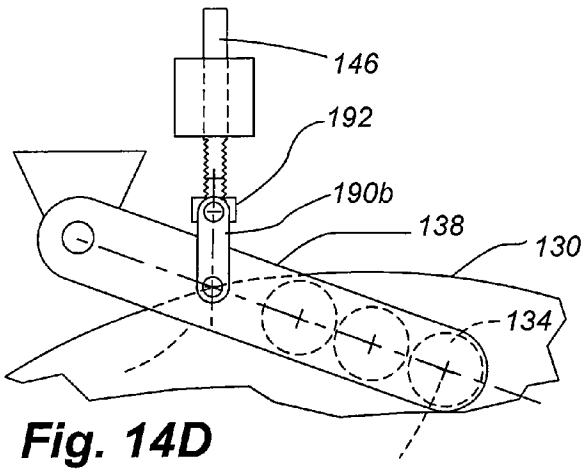
FIG. 14D shows a schematic of a portion of the brake assembly in a fourth position.
Figure 14A:
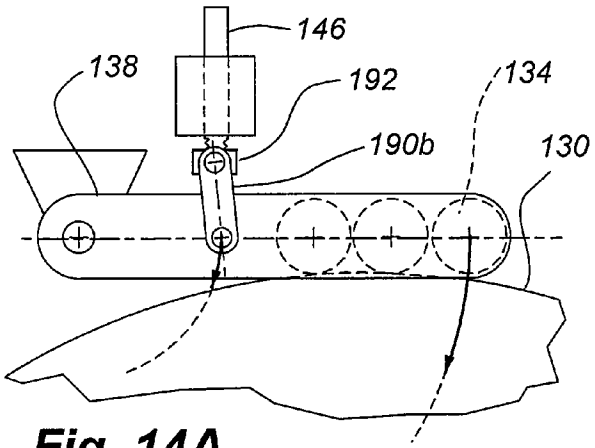
FIG. 14A shows a schematic of a portion of the brake assembly in a first position.
Figure 14C:
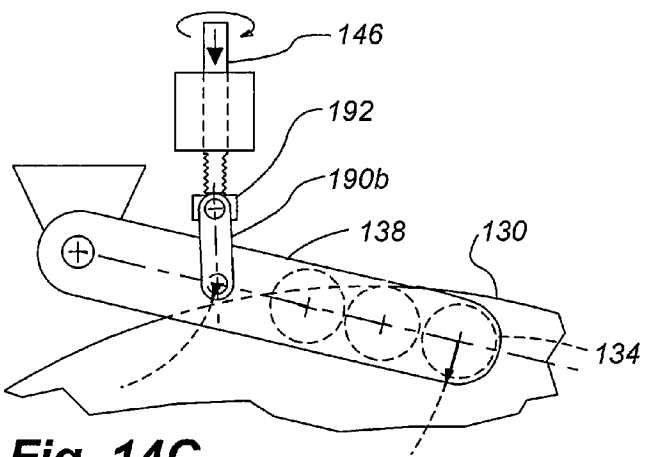
FIG. 14C shows a schematic of a portion of the brake assembly in a third position.

With further reference to FIGS. 14A-14D, the right and left links 190*a-b* pivot relative to the link plate 192 and the brackets 136, 138 as the brackets 136, 138 are moved from the position shown in FIG. 14A to the position shown in FIG. 14D. With reference to FIG. 14A, a longitudinal axis of the right and left links 190*a-b* extends at an angle from the longitudinal axis of the adjustment member 146. As the brackets 136, 138 move from the position in FIG. 14A to the position in FIG. 14D, the right and left links 190*a-b* pivot relative to the link plate 192 and the brackets 136, 138 in a direction that generally aligns the longitudinal axis of the right and left links 190*a-b* with the longitudinal axis of the adjustment member 146. As the longitudinal axes of the right and left links 190*a-b* align more with the longitudinal axis of the adjustment member 146, the rate the magnets 134 overlap the flywheel 130 for each incremental unit of rotation of the adjustment member 146 decreases. In other words, as the magnets 134 overlap a greater portion of the flywheel 130, the rate at which the magnets 134 further overlap the flywheel 130 may decrease for a given incremental movement of the control knob 170 for at least a portion of the adjustment range of the adjustment member 146 to create a more proportional increase in the magnetic forces opposing rotation of the flywheel 130.

Figure 15:
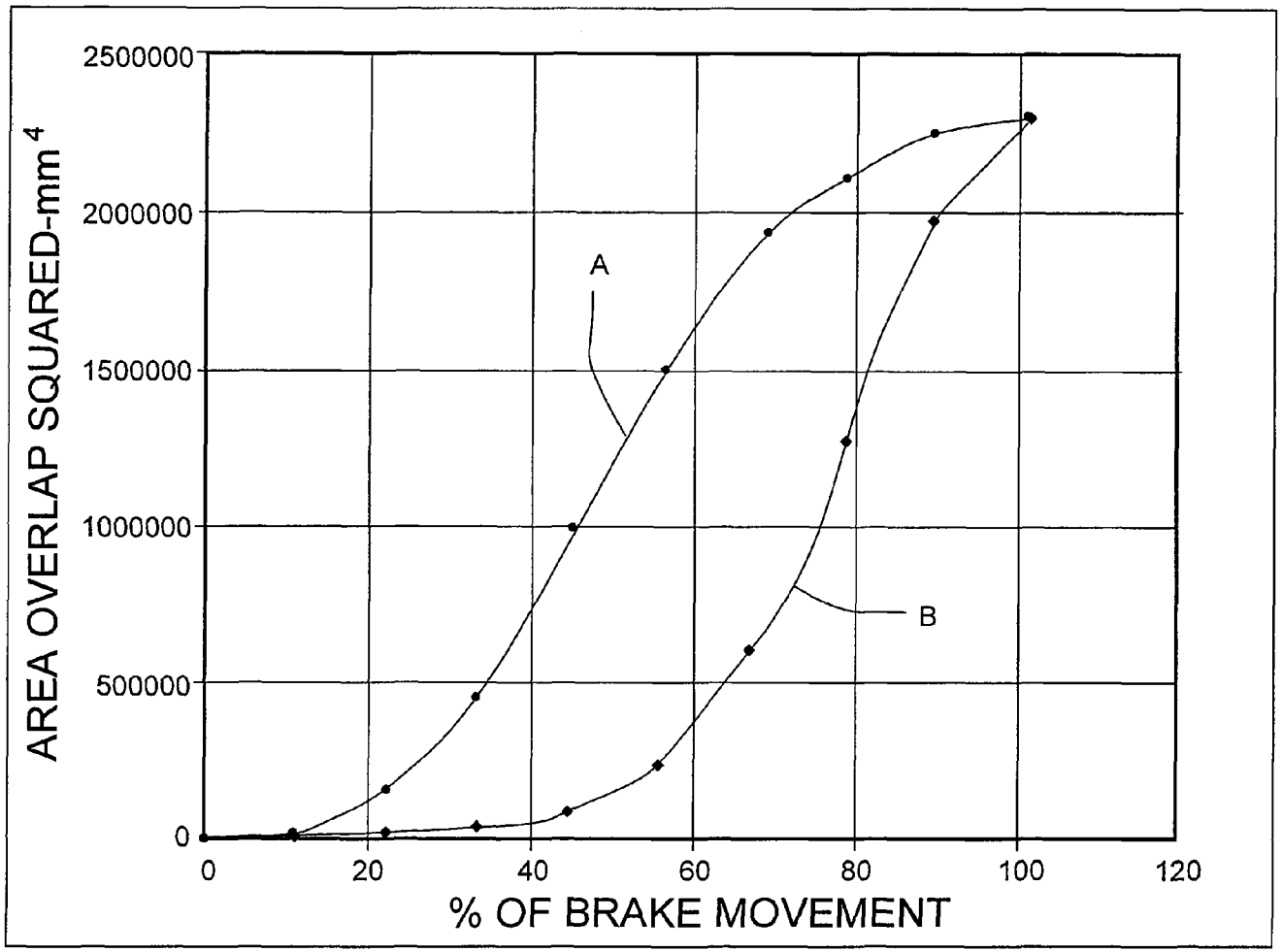
FIG. 15 is chart showing percentage of brake movement vs. area of magnet overlap.

This non-linear movement of the magnets 134 over a greater portion of the flywheel 130 as the magnets 134 overlap more of the flywheel 130 creates a more proportional increase in the forces opposing rotation of the flywheel 130 for a given incremental movement of the control knob 170 within at least a range of the total range of movement of the control knob 170. FIG. 15 shows a graph of a calculated area of magnet overlap versus percentage of total movement of the adjustment assembly 140 for two configurations of an adjustment assembly 140. The data for the first configuration is identified as "A" in the graph, and the data for the second configuration is identified as "B" in the graph. The first configuration is based on an adjustment assembly similar to the adjustment assembly shown in FIGS. 9-13. The second configuration differs from the configuration shown in the drawings. Some of the differences between the second configuration and the first configuration are the brackets 136, 138 of the second configuration were pivoted from their front ends rather than their rear ends and the center of the magnets 134 of the second configuration were aligned along an arc rather than along a straight line.

As shown in FIG. 15 with respect to the first configuration, up until about 25% percent of the total movement range of the magnets 134 via the adjustment assembly 140, the overlap of the magnets 134, and thus the forces opposing rotation of the flywheel 130, increase in a substantially non-proportional manner. From about 25% to about 65% of the total movement range of the adjustment assembly 140, the overlap of the magnets 134, and thus the flywheel opposition force, increases in a substantially proportional manner, which may take the form of a substantially linear relationship. Above about 65%, the overlap of the magnets 134, and thus the flywheel opposition force, return to increasing in a more non-proportional manner. Thus, for a portion of movement of the adjustment assembly 140 from about 25% to about 65% of the total range of movement of the adjustment assembly 140, the forces opposing the rotation of the flywheel 130 increase in a substantially linear manner relative to the movement of the adjustment assembly 140 (i.e., a given incremental movement of the adjustment assembly 140 will cause a proportional incremental increase in the forces opposing rotation of the flywheel 130 throughout this movement range).

The data for the second configuration shows that changing the configuration of the brake assembly 132 can result in differing amounts of magnet 134 overlap over the movement range of the adjustment assembly 140. More particularly, for the second configuration it took longer for all of the magnets 134 to overlap the flywheel 130 than for the first configuration, thus resulting in less overlap of the flywheel 130 by the magnets 134 in the early stages of the brake's movement through its range of movement compared to the first configuration. In both configurations, once all of the magnets 134 began overlapping the flywheel 130, the overlap for additional movements of the brake increased at a much greater rate for both configurations.

Figure 16A:
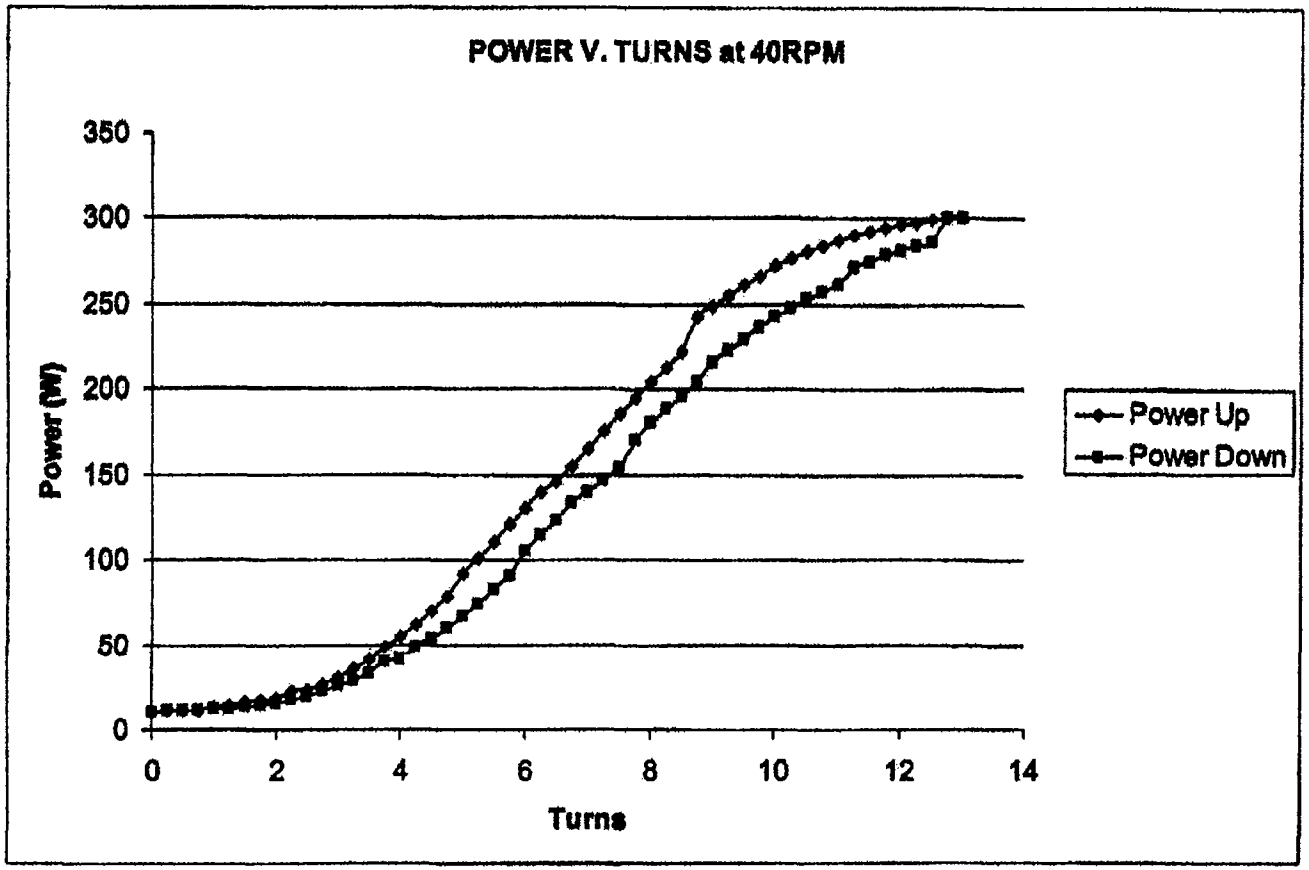
FIG. 16A is a graph showing test data for power versus turns of a control knob at a crank speed of 40 rpm for a prototype of an exercise bike having a resistance assembly as shown in FIGS. 2-5D.
Figure 16B:
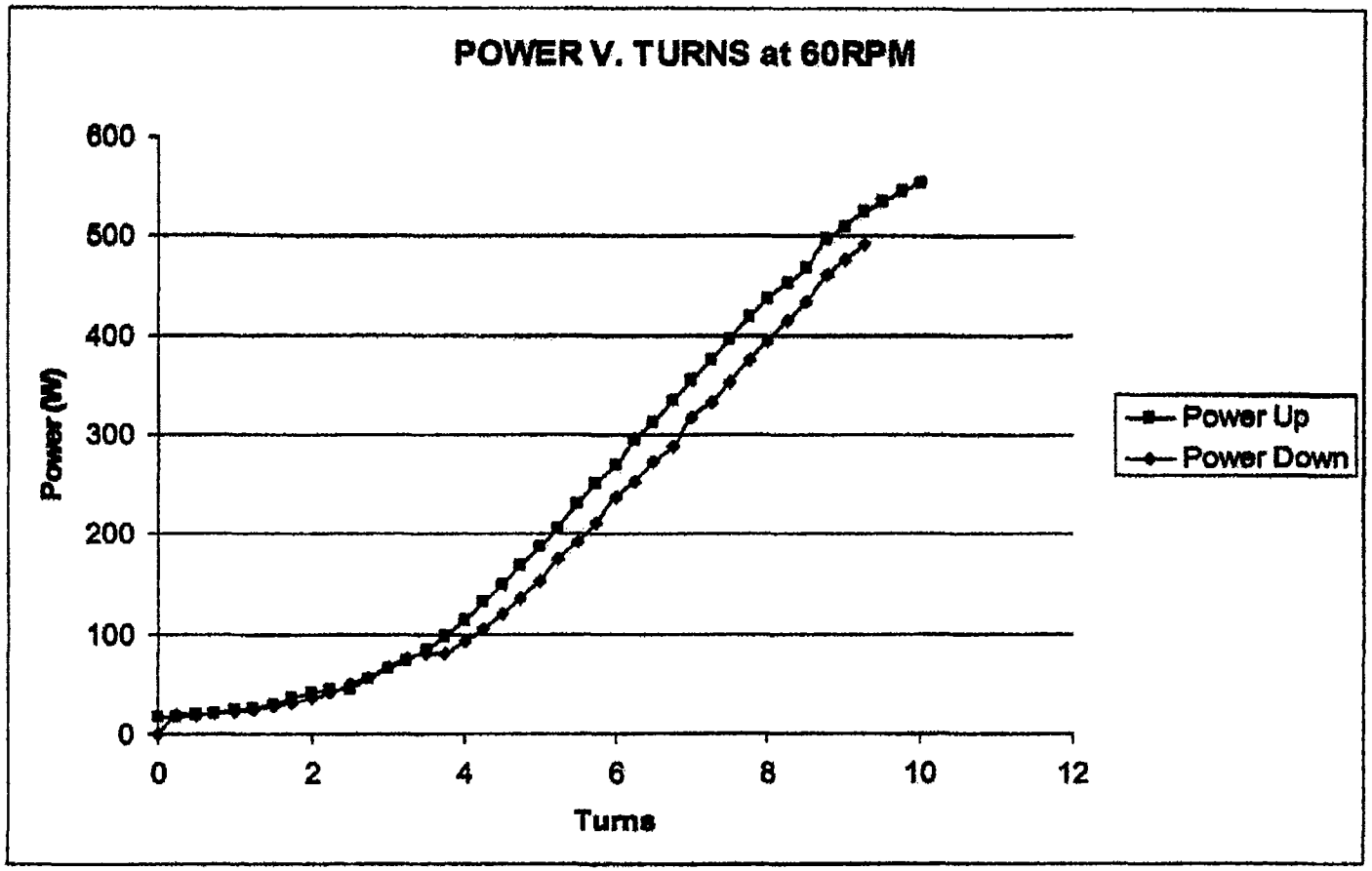
FIG. 16B is a graph showing test data for power versus turns of a control knob at a crank speed of 60 rpm for a prototype of an exercise bike having a resistance assembly as shown in FIGS. 2-5D.
Figure 16C:
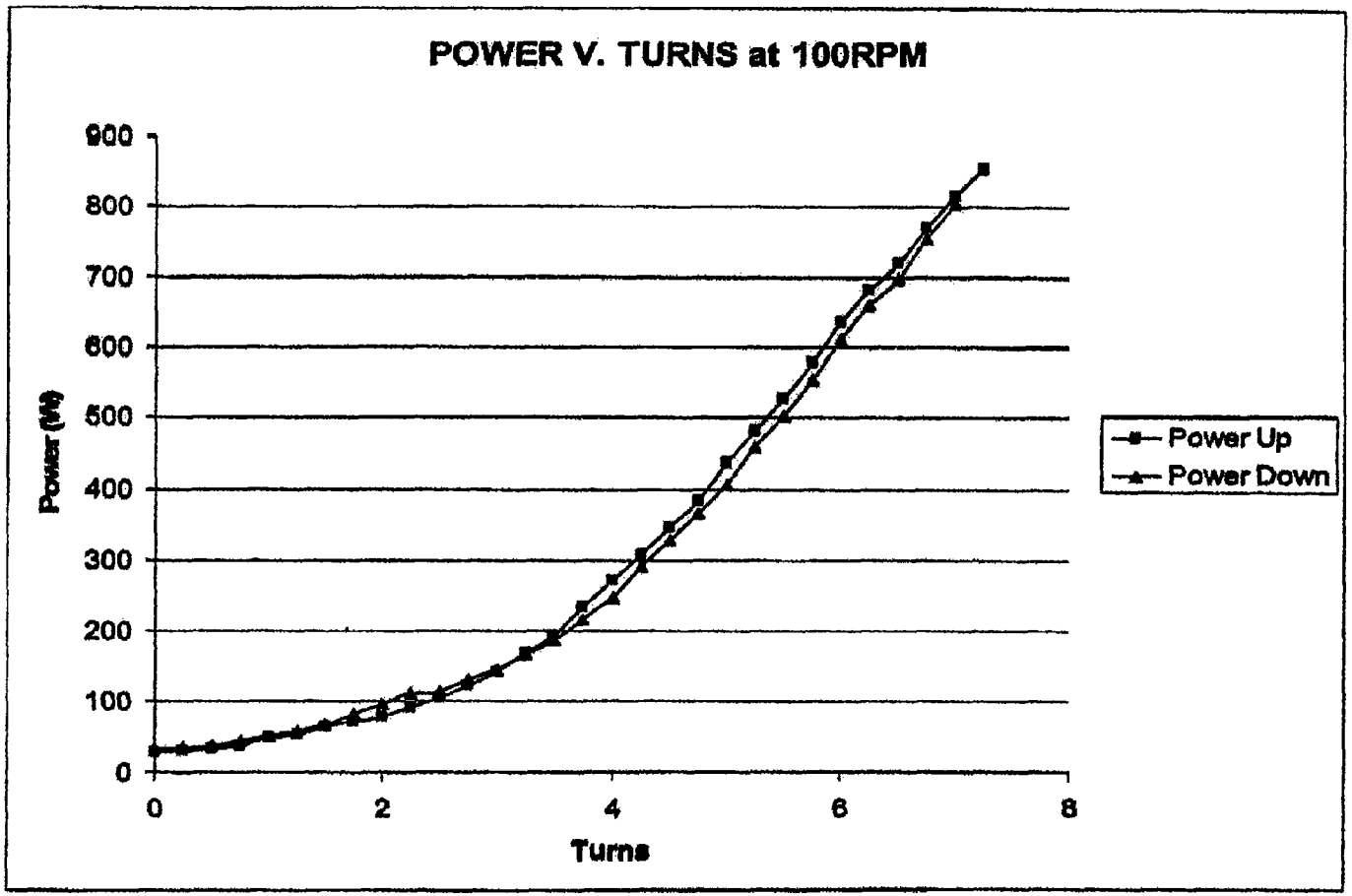
FIG. 16C is a graph showing test data for power versus turns of a control knob at a crank speed of 100 rpm for a prototype of an exercise bike having a resistance assembly as shown in FIGS. 2-5D.

FIGS. 16A-C show test data for power versus complete turns of an adjustment member 146 for an exercise bike 100 with a resistance assembly 104 similar to the one shown in FIGS. 2-5D. FIG. 16A shows the power measured for various turns of the adjustment member 146 at a crank speed of 40 rpm. FIG. 16B shows the power measured for various turns of the adjustment member 146 at a crank speed of 60 rpm. FIG. 16C shows the power measured for various turns of the adjustment member 146 at a crank speed of 100 rpm. With reference to FIGS. 16A-16C, it may be noted that power increases and decreases in a substantially proportional manner, in this case in a substantially linear manner, from approximately 4 to 8 full complete turns. Below 4 complete turns, the power tends to increase and decrease in a less proportional manner at each rpm. Above approximately 8 complete turns, the power also tends to increase and decrease in a less proportional manner, especially as seen at 40 rpm. The turn range over which this proportional change occurs is typically the turn range within which a user would operate the exercise bike 100.

It may also be noted that there was a slight difference in measured power at a given adjustment member turn position and a given crank speed when increasing (i.e., power up) and decreasing (i.e., power down) the resistance. It is believed that these slight differences in measured power are a function of some relatively imprecise mechanical connections that join the various braking and adjustment components together in the test bike. Nonetheless, the proportional characteristics of power versus turns of the adjustment member 146 over a portion of the adjustment range were observed when both increasing and decreasing the resistance at all crank speeds.

Returning to FIG. 13, the control knob 170 may be pressed down to relatively quickly slow down or stop the rotation of the flywheel 130. When the control knob 170 is pressed down, the adjustment member 146 moves vertically downward. The vertical downward movement of the adjustment member 146 causes the link assembly 174 to move downward and the right and left brackets 136, 138 to pivot towards the flywheel 130 until the friction brake pad 196 engages a peripheral rim of the flywheel 130. Sufficient engagement of the brake pad 196 with the flywheel 130 causes a relatively rapid decrease in the rotation of the flywheel 130 that allows the user to relatively quickly slow down or stop the rotation of the flywheel 130. Upon release of the downward force, the bias member 148 returns the adjustment member 146 to its original position, thus disengaging the brake pad 196 from the flywheel 130.

As shown in FIG. 13, as the friction brake pad 196 engages the flywheel 130, the magnets 134 also overlap the flywheel 130. Thus, in addition to the friction force applied to the flywheel 130 that resists rotation of the flywheel 130, the rotation of the flywheel 130 is also resisted by the eddy current brake. Because of this additional eddy current braking force, the force that needs to be applied between the brake pads 196 and the flywheel 130 for the friction brake to stop the flywheel 130 within a given time period for a given cadence may be less than the force required for a comparable friction brake alone. In other words, it may take less force input from the user to stop the flywheel 130 in a given time period with the friction brake when combined with the eddy current brake than it does when the friction brake is not combined with an eddy current brake.

Figure 17:
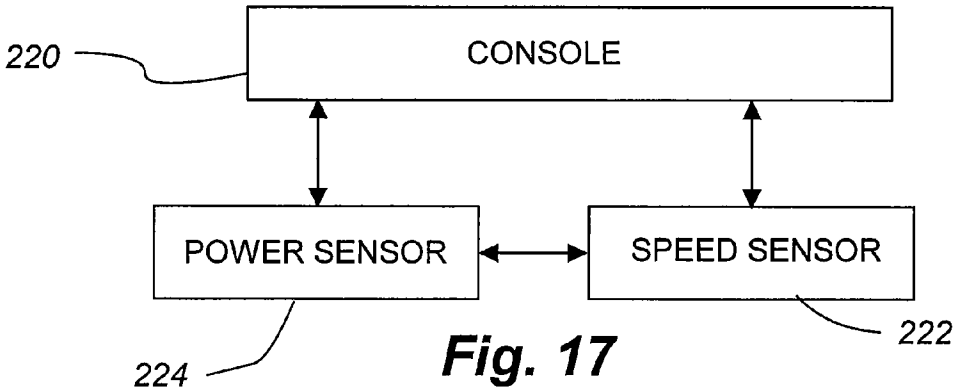
FIG. 17 shows a schematic of a console and monitoring system for the exercise bike of FIG. 1.

The exercise bike 100 may further include a monitoring system and a console 220. Turning to FIG. 17, the monitoring system may include a speed sensor 222 for measuring the revolutions per unit time of the flywheel 130 and a power sensor 224 for estimating the power generated by a user. The console 220 may be configured to show this and other information to the user. The speed sensor 222, the power sensor 224, and the console 220 may each be configured to transmit and receive signals representing information, such as speed or power, between these components via a wireless or wired connection.

The speed sensor 222 may be any suitable sensor that can measure the revolutions per unit of time (e.g., revolutions per minute) of a rotating object, such as a flywheel. As an example, the speed sensor 222 may be a magnetic speed sensor that includes a sensor and a sensor magnet. To protect the sensor, the sensor may be mounted in a sensor housing, which may be mounted on the frame 106 of the exercise bike 100 proximate the flywheel 130. The sensor magnet may be mounted on the flywheel 130 such that it periodically passes proximate the sensor as the flywheel 130 rotates so that the sensor can determine how fast the flywheel 130 is rotating. The speed sensor 222 may send a signal indicative of the flywheel speed to the power sensor 224. The speed sensor 222 may also send a signal indicative of the flywheel speed to the console 220. Although described in the example as a magnetic speed sensor, the speed sensor could be an optical speed sensor or any other type of speed sensor.

Figure 18:
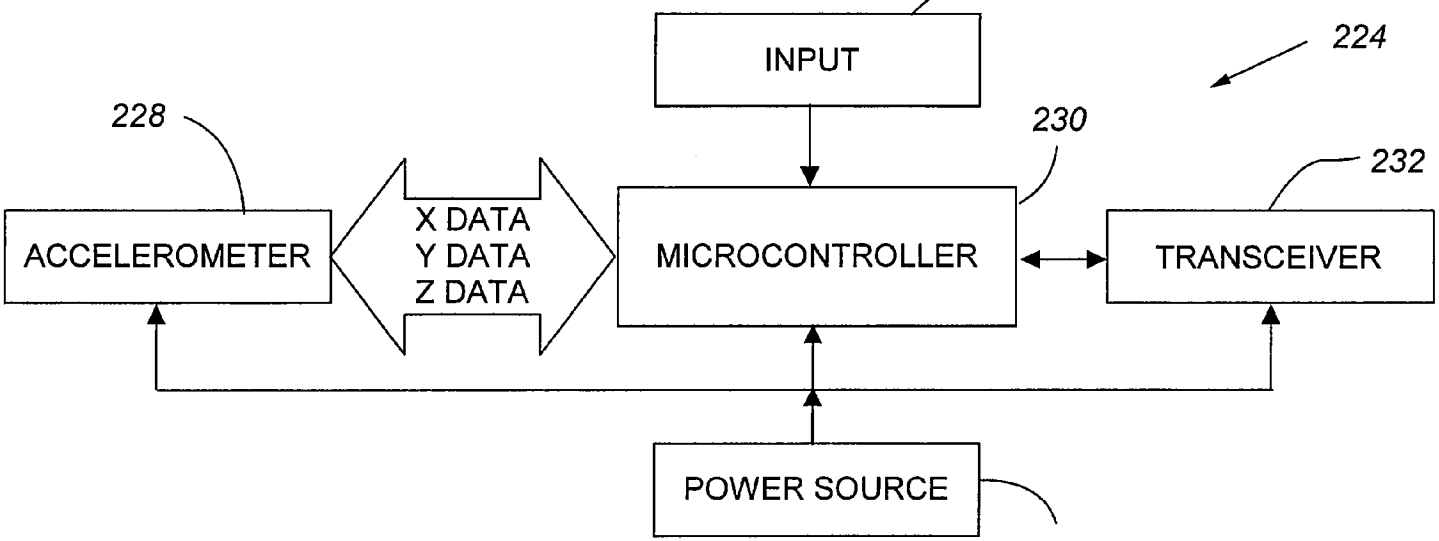
FIG. 18 shows a schematic of a power sensor for the exercise bike of FIG. 1.

With reference to FIG. 18, the power sensor 224 may include a power source 226, an accelerometer 228, a microcontroller 230, a transceiver 232 and an interface component 236. The transceiver 232, accelerometer 228, microcontroller 230 and the interface component 236 may be mounted on a board. The board may be mounted on a power sensor housing for joining the power sensor 224 to the brake assembly 132. More particularly, the power sensor housing may be connected by mechanical fasteners or other suitable connection methods to one of the brackets 136, 138. Although FIG. 2 shows the power sensor 224 joined to the right bracket 136, the power sensor could be joined to the left bracket 138.

The power source 226 provides power to the other components of the power sensor 224, including the accelerometer 228, the microcontroller 230, and the transceiver 232. The power source 224 may be one or more batteries, such as double AA batteries, or any other suitable power supply. The power source 224 may further include a power conditioner, such as TPS60310DGS single-cell to 3-V/3.3-V, 20-mA dual output, high-efficiency charge pump sold by Texas Instruments. The power conditioner may be connected to the power source 226 to condition the voltage provided from the power source 226 to a desired voltage. The conditioned power may then be supplied to other components of the power sensor 224. The power source 226 may be mounted in the power sensor housing and the power conditioner may be mounted on the board.

The accelerometer 228 facilities determining a tilt angle for the brackets 136, 138 relative to a reference position. The tilt angle helps determine power, which is described in more detail below. For convenience, the reference position may be calibrated in the accelerometer using the upper stop position for the brackets 136, 138. However, other positions of the brackets 136, 138 relative to the frame could be used as the reference position. Once calibrated, the accelerometer 228 may be used to measure changes in the position of the brackets 136, 138 from the reference position as the brackets 136, 138 are selectively moved relative to the flywheel 130 using the adjustment member 146 to increase or decease the resistance applied by the magnetic field to the flywheel 130. Using this measured position information, the tilt angle of the brackets 136, 138 relative to the reference position may be determined. For example, by knowing the changes in the x and y positions of the accelerometer 228 from the reference position, an angle can be calculated using geometrical equations, such as arc tan, that represent the tilt angle of the brackets 136, 138. The accelerometer 228 may be a MMA7260Q three-axis acceleration sensor sold by Freescale Semiconductor or any other suitable acceleration sensor.

The microcontroller 230 may be an ATmega168PV-10AU microcontroller sold by Atmel Corporation or any other suitable microcontroller. The microcontroller 230 controls the other components of the power sensor 224 and calculates information of interest, such as power or crank speed. The microcontroller 230 may receive signals from the transceiver 232 representing information of interest, such as the speed of the flywheel 130 (e.g., number of revolutions per minute), and provide signals to the transceiver 232 representing information of interest, such as the estimated power of the user. The microcontroller 230 may also receive information from the accelerometer 228, such as position of the bracket members 136, 138 relative to the reference point. Using this information, the microcontroller 230 may determine the tilt angle of the bracket members 136, 138. The microcontroller 230 may also convert the flywheel speed to a crank speed. Yet further, using the determined tilt angle and either flywheel or crank speed, the microcontroller 230 may be used to estimate the user's power. This is described in more detail below.

To estimate a user's power, a power look-up table 234, such as the one shown in FIG. 19, may be stored in the microcontroller 230. The power look-up table 234 may be based on the tilt angle from the reference position and the speed in revolutions per minute of the cranks. Using the tilt angle and the crank speed, the power corresponding to the measured tilt angle and crank speed may be looked up in the table. Power values that correspond to specific tilt angles and crank speeds for use in the power look-up table may be determined by measuring and recording the power of one or more reference bikes at different tilt angles and crank speeds using a dynamometer or other power measurement device. When more than one exercise bike is used, the power values may represent an average of the power measured at respective tilt angles and crank speeds for each bike. For speeds or tilt angles that fall between the values provided in the power look-up table 234, the power may be determined using an interpolation method, such as bi-linear interpolation. While the power look-up table 234 is shown as using crank speed to determine power, in some embodiments the flywheel speed may be used in the power look-up table rather than the crank speed. Further, while the tilt angles and speeds are shown as ranging from 0 to 20 degrees for the tilt angle and 0-120 revolutions per minute for the speed, other ranges for the tilt angles and speeds may be used in the power look-up table 234.

Because of manufacturing tolerances, differences in material properties of similar components, and so on, the powers measured for the reference bike and other exercise bikes at given tilt angles and crank speeds may vary even though the bikes are constructed to be the same. To estimate these differences, the power obtained from the power look-up table 234 may be modified by one or more predetermined adjustment factors for each exercise bike 100. For example, the power obtained from the power look-up table 234 may be adjusted by two adjustment factors. The first adjustment factor may be used to account for differences between the exercise bike 100 and the reference bike in the mechanical drag of the drive train system and the flywheel 130, and the second adjustment factor may be used to account for differences between the exercise bike 100 and the reference bike in resistances provided to the flywheel 130 by the magnetic field due to relative positioning of the magnets to each other, different magnetic strengths of the magnets and so on. For convenience, the first adjustment factor may be referred to as the mechanical drag adjustment factor, and the second factor may be referred to as the magnetic field adjustment factor.

The mechanical drag adjustment factor may be estimated using one or more baseline spin-down tests or processes. More particularly, the right and left brackets 136, 138 for the reference bike may be moved to the upper stop position. In the upper stop position, the flywheel 130 experiences little to no resistance from the magnetic field generated by the magnets because the magnets do not overlap the flywheel 130. The flywheel 130 for the reference bike may then spun up to a speed greater than a predetermined speed. After spinning up the flywheel 130, the flywheel 130 is allowed to spin freely without further input, which results in the speed of the flywheel 130 decreasing. Once the flywheel speed reaches the predetermined speed, the time it takes for the flywheel 130 of the reference bike to slow down to a second predetermined speed is measured. A similar baseline spin-down is performed on the exercise bike 100.

The time for the flywheel 130 of the exercise bike 100 to slow down from the first predetermined speed to the second predetermined speed is compared to the time for the reference bike. If the time for the exercise bike 100 is less than the reference bike, the power from the look-up table 234 is factored upward since the baseline spin down indicates that more power is required to reach similar flywheel speeds for the exercise bike 100 than for the reference bike to overcome mechanical drag. If the time for the exercise bike 100 is greater than the reference bike, the power from the look-up table 234 is factored downward since the baseline spin-down indicates that less power is required to reach similar flywheel speeds for the exercise bike 100 than for the reference bike in order to overcome mechanical drag. The comparison for the baseline spin-down process may be performed using the microprocessor 230. The mechanical drag adjustment factor may also be determined and stored using the microprocessor 230.

The magnetic field adjustment factor may be estimated using a calibration spin-down. The calibration spin-down is similar to the baseline spin-down except the brackets 136, 138 for the reference bike and the exercise bike 100 are positioned to a predetermined tilt angle such that the magnetic field generated by the magnets 134 resists rotation of the flywheel 130. Like the baseline spin-down process, the flywheels 130 for both the reference bike and the exercise bike 100 are spun up above a predetermined speed and then allowed to slow down. Also like the baseline spin-down process, the time for the flywheels 130 of the reference bike and the exercise bike 100 to slow down from the first predetermined speed to a second predetermined speed are measured and compared to establish the magnetic field adjustment factor for the exercise bike. Again, if it takes less time for the flywheel 130 of the exercise bike 100 to slow down than the flywheel for the reference bike, the power obtained from the look-up table 234 is adjusted upward by the magnetic field adjustment factor; if it takes more time, the power obtained from the look-up table 234 is adjusted downward by the magnetic field adjustment factor.

In addition to differences in the mechanical drag and magnetic fields between exercise bikes 100, the power obtained from the look-up table 234 may need to be altered by accelerations and decelerations of the flywheel 130. When the flywheel's speed is accelerated by a user from a first speed to a second speed, the power required to reach the second rotation speed is greater than the power required to maintain the second rotation speed at a given resistance because of the inertia of the flywheel 130. Similarly, when the flywheel's speed is decelerated by the user from a first speed to a second speed, the power required to reach the second rotation speed is less than the power required to maintain the second speed at a given resistance. To account for this power adjustment for accelerations and decelerations of the flywheel 130, the accelerations and decelerations of the flywheel 130 may be monitored by the microcontroller 230 based on speed information received from the speed sensor 224. When the microcontroller 230 determines the flywheel 130 is being accelerated or decelerated, the power obtained from the look-up table 234 may be adjusted by the following equation:

$$\text{Power}_{(acceleration)}=I_t*\alpha*\omega$$

where, $I_t$ is the total drive train inertia;

$\alpha$ is the rotational acceleration at the cranks; and $\omega$ is the rotation velocity at the cranks.

This acceleration power adjustment is positive for accelerations and negative for decelerations. Further, when the flywheel 130 rotates at a constant speed, this adjustment factor is zero since the rotational acceleration is zero.

In embodiments of the exercise bike 100 that include power adjustments for mechanical drag, magnetic field and acceleration, the estimated power output by the user may be determined using the following equation:

$$\text{Power}_{(user)}=P_{(LUT)}+(k_1+k_2)*P_{(LUT)}+P_{(acceleration)}$$

where, $\text{Power}_{(user)}$ is the power output by the user;

$P_{(LUT)}$ is the power obtained from the lookup table based on crank speed and tilt angle;

$k_1$ is an adjustment factor for mechanical drag;

$k_2$ is an adjustment factor for the magnetic field; and $P_{(acceleration)}$ is the power of acceleration or deceleration.

The foregoing equation is merely illustrative of one potential equation for estimating the power of a specific exercise bike. In other embodiments, the power may be obtained from just the look-up power table 234 or may be calculated using other approaches or methods to determine the power.

For example, as another approach, power may be estimated using one or more equations derived using power curves, such as the power curves shown in FIGS. 16A-C, obtained from test data. The equations could then be used to estimate power as a function of one or more of turns of the knob 170 and crank or flywheel speed. Turns of the knob 170 could be determined by correlating turns of the knob 170 to the position measured by the accelerometer 228 relative to a reference position. The one or more equations could be complex polynomials that approximate relatively accurately the curves generated from the test data or could be less complex polynomial or other equations that less accurately approximate the curves. As an example of a less complex equation, three linear equations could be used to model the power curve at 40 rpms shown in FIG. 16A, with one linear equation modeling the curve up to about 4 turns, the second linear equation modeling the curve from about 4 turns to about 9 turns, and the third linear equation modeling the curve above 9 about turns. Such an approach would tend to overestimate the power for less than 4 turns and underestimate the power for greater than 9 turns. Power between speeds for which there is not any test data to form equations could be estimated in the foregoing example by interpolating between the results obtained using equations derived from speeds just below and above the desired speed. The foregoing example is merely illustrative of one approach to using equations to estimate power for an exercise bike.

Figure 20:
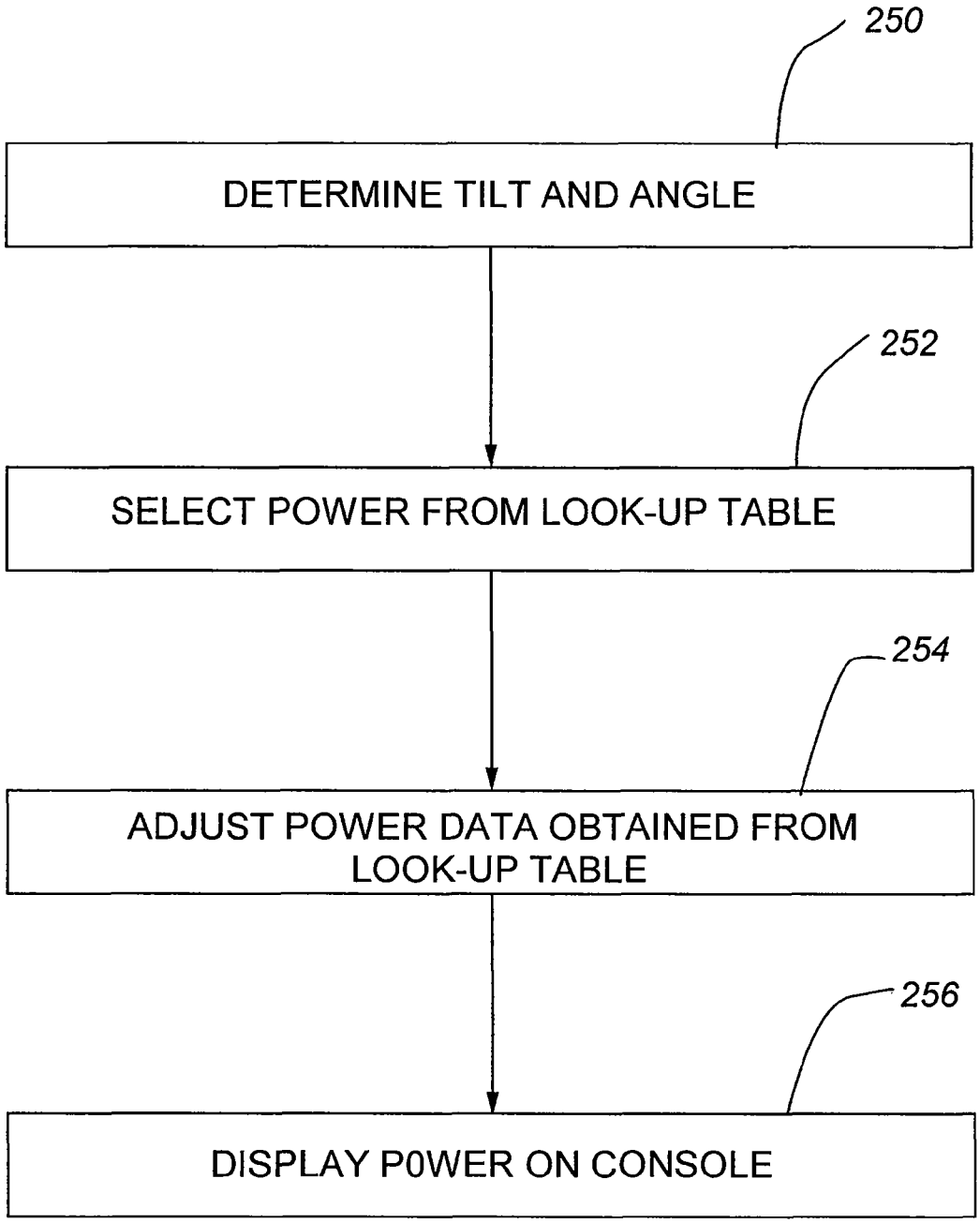
FIG. 20 shows a flow chart for displaying power information for the exercise bike of FIG. 1.

In sum, the power input by the user, which may also be referred to as the user's power output, may be determined by the following steps. With reference to FIG. 20, the tilt angle of the brackets and the crank speed of the exercise bike may be determined in step 250. In step 252, a power is selected from the power look-up table 234 using the measured tilt angle and crank speed (or flywheel speed) or is determined using an equation. In optional step 254, the power obtained from the look-up table 234 may then be adjusted by one or more adjustment factors to account for mechanical drag and differences in magnetic field strengths between the exercise bike 100 and the reference bike and for accelerations or decelerations of the flywheel 130. In step 256, the power, either adjusted or unadjusted, may then be delivered to the console 220 via a signal for display on the console 220.

The transceiver 232 may transmit and receive signals from the microcontroller 230, the speed sensor 222 and the console 220. For example, the transceiver 232 may receive a signal indicative of flywheel speed from the speed sensor 222 and transmit this signal to the microcontroller 230. As another example, the transceiver 232 may receive a signal indicative of power output by the user from the microcontroller 230 and transmit this signal to the console 220. The foregoing examples are merely illustrative and not intended to imply or require the transceiver 232 to transmit or receive specific signals or to limit the transceiver 232 to receiving and transmitting particular signals. The transceiver 232 may be a ANT11TS33M4IB transceiver sold by Dynastream Innovations Inc. or any other suitable transceiver.

The interface component 236 may be connected to the microcontroller 230. The interface component 236 allows the software for the microcontroller 230 to be uploaded, debugged and updated. The interface component 236 may be a six pin ISP/debugWire interface or any other suitable interface.

The console 220 may include a display screen for displaying information and a transceiver or the like for communicating with the power sensor 224 and the speed sensor 222. The console 220 could receive data that is displayed without further processing, or could receive raw data that would be processed within the console 220 to convert the raw data into the information that is displayed, such as power. The console 220 may be mounted on the handle bars 118 or on any other suitable location on the frame 106 where a user can access the console 220 while using the exercise bike 100. The console 220 may display information such power, cadence or speed, time, heart rate, distance, resistance level, and so on. The console 220 may also include a microcontroller or the like to control other components of the console 220 or to perform calculations.

As described herein, an exercise bike may include a magnetic braking system to resist rotation of a flywheel by a user. The magnetic braking system may take the form of magnets mounted on brackets that may be selectively pivoted relative to the frame to increase or decrease the resistance opposing rotation of the flywheel. The brackets may be pivoted using an adjustment assembly joined to the brackets in such a manner that the magnetic forces resisting rotation of the flywheel increase or decrease in a proportional manner over at least a portion of the adjustment range of the adjustment assembly.

The exercise bike may further include a console that displays information, such as power. The power may be estimated from a look-up table using the crank or flywheel speed of the exercise bike and the tilt angle of the brackets relative to a reference point. The look-up table may be created by measuring the power of a reference bike for various crank or flywheel speeds and tilt angles. The flywheel speed may be measured using a speed sensor joined to the exercise bike, and the tilt angle may be using measured using a power sensor that includes an accelerometer. The power obtained from the look-up table may be adjusted by adjustment factors to account for differences, such as mechanical drag and magnetic field variations, between the exercise bike and the reference bike. The adjustment factors may be determined using one or more spin-down tests or processes. The power may be further adjusted by taking into account the power associated with accelerations and decelerations of the flywheel by the user.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise bike, comprising:

a frame;

a drive train operatively associated with the frame;

a flywheel operatively associated with the drive train; and a braking assembly comprising:

an elongated adjustment member defining a longitudinal axis;

a friction brake operatively associated with the elongated adjustment member, wherein pressing down on the elongated adjustment member engages the friction brake with the flywheel a magnetic brake comprising:

a first bracket joined to at least one first magnet, operatively associated with the frame, and positioned proximate the flywheel; and a second bracket joined to at least one second magnet, operatively associated with the frame, and positioned proximate the flywheel; and a link assembly including at least one link operatively associated with the elongated, adjustment member, the first bracket, and the second bracket;

wherein the elongated adjustment member, the magnetic brake and the link assembly are configured such that rotation of the elongated adjustment member around the longitudinal axis of the elongated adjustment member causes the first bracket and the second bracket to pivot in the same direction and moves the first bracket and the second bracket via the at least one link between at least first and second positions where at the first position the at least one first magnet and the at least one second magnet at least partially overlap the flywheel to operatively associate the magnetic brake with the flywheel and at the second position the at least one first magnet and the at least one second magnet do not overlap the flywheel to operatively disassociate the magnetic brake with the flywheel,

2. The exercise bike of claim 1, wherein the flywheel includes an inner radial portion formed of a first type of material and an outer radial portion formed of a second type of material different than the first type of material.

3. The exercise bike claim 2, wherein the second type of material comprises a non-ferrous, conductive material,

4. The exercise bike claim 3, wherein the first type of material comprises steel second the type of comprises aluminum.

5. The exercise bike of claim 1, wherein the first bracket and the second bracket pivot about a common pivoting axis.

6. The exercise bike of claim 5, wherein the common pivoting axis of the first bracket and the second bracket is substantially parallel to a rotating axis of the flywheel.

7. The exercise bike of claim 5, wherein the common pivoting axis of the first bracket and the second bracket is above a rotating axis of the flywheel.

8. The exercise bike of claim 5, wherein the common pivoting axis of the first bracket and the second bracket is above and outside an outer radial surface of the flywheel.

9. The exercise bike of claim 5, wherein when the first bracket and the second bracket move towards the first position to operatively associate the magnetic brake with the flywheel, the first bracket and the second bracket pivot about the common pivoting axis in a first direction; when the first bracket and the second bracket move towards the second position to operatively disassociate the magnetic brake with the flywheel, the first bracket and the second bracket pivot about the common pivoting axis in a second direction that is opposite the first direction.

10. The exercise bike of claim 1, wherein the link assembly further includes a link plate including a hole that receives the elongated adjustment member therethrough, the at least one link is operatively associated with the elongated adjustment member by pivotally joining the at least one link to the link plate, and the at least one link is operatively associated with the first bracket by pivotally joining the at least one link to the first bracket,

11. The exercise bike of claim 10, wherein:

the at least one link defines a link longitudinal axis;

in the second position, the link longitudinal axis extends at an angle from the longitudinal axis of the elongated adjustment member; and as the first and second brackets move from the second position to the first position, the at least one link pivots relative to the link plate and the first bracket in such a manner that the link longitudinal axis more closely aligns with the longitudinal axis of the elongated adjustment. member at the first position than at the second position.

12. The exercise bike of claim 1, wherein the elongated adjustment member, the magnetic brake, and the link assembly are further configured such that for at least a portion of an adjustment range, an incremental rotation of the elongated adjustment member causes a substantially proportional change in a resistance exerted by the magnetic brake on the flywheel.

13. The exercise bike of claim 1, wherein the friction brake comprises a brake pad joined to the first bracket and the second bracket, and the brake pad includes a curved surface that conforms to an outer surface of the flywheel

14. The exercise bike of claim 1, wherein when at the first position, at least a portion of the flywheel is positioned between the first bracket and the second bracket.

15. The exercise bike of claim 1, wherein when at the second position, at least a portion of the first bracket and at least a portion of the second bracket are located above an outer radial surface of the flywheel,

16. The exercise bike of claim 1, wherein when the first bracket and the second bracket move towards the first position to operatively associate the magnetic brake with the flywheel, the first bracket and the second bracket move towards a rotating axis of the flywheel.

17. The exercise bike of claim 1, wherein when the first bracket and the second bracket move towards the second position to operatively disassociate the magnetic brake with the flywheel, the first bracket and the second bracket move away from a rotating axis of the flywheel.

* * * * *